US007110688B2

(12) United States Patent
Takahashi et al.

(10) Patent No.: US 7,110,688 B2
(45) Date of Patent: Sep. 19, 2006

(54) IMAGE FORMING DEVICE THAT ADJUSTS IMAGE DENSITY BASED ON DEVELOPING BIAS AND PRESSING FORCE

(75) Inventors: Keisuke Takahashi, Kasugai (JP); Masashi Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 82 days.

(21) Appl. No.: 11/018,498

(22) Filed: Dec. 22, 2004

(65) Prior Publication Data

US 2005/0141909 A1 Jun. 30, 2005

(30) Foreign Application Priority Data

Dec. 26, 2003 (JP) ..... 2003-434738

(51) Int. Cl.
*G03G 15/08* (2006.01)
*G03G 15/10* (2006.01)

(52) U.S. Cl. ..... 399/53; 399/55; 399/279; 399/285; 399/286

(58) Field of Classification Search ..... 399/53, 399/55, 111, 113, 119, 279, 285, 286
See application file for complete search history.

(56) References Cited

U.S. PATENT DOCUMENTS 6,157,794 A * 12/2000 Katsumi et al. ..... 399/53

FOREIGN PATENT DOCUMENTS

| | | |
|---|---|---|
| JP | A 09-311510 | 12/1997 |
| JP | A 10-083121 | 3/1998 |
| JP | A 11-327293 | 11/1999 |
| JP | A 2002-328525 | 11/2002 |
| JP | A 2002-333772 | 11/2002 |

* cited by examiner

*Primary Examiner*—Hoang Ngo
(74) *Attorney, Agent, or Firm*—Oliff & Berridge, PLC

(57) ABSTRACT

An image forming device includes a developer bearing member, a photosensitive member, a developing-bias applying portion, a pressing-force adjusting portion, and a density adjusting portion. The photosensitive member is disposed in contact with the developer bearing member. An electrostatic latent image is formed on the photosensitive member and developed by the developer supplied from the developer bearing member for forming a developer image. The developing-bias applying portion applies a developing bias to the developer bearing member. The pressing-force adjusting portion adjusts the pressing force between the developer bearing member and the photosensitive member. The density adjusting portion controls both the developing-bias applying portion and the pressing-force adjusting portion to adjust, based on adjustment of both the developing bias and the pressing force, an amount of developer in the developer image developed on the photosensitive member, thereby adjusting density of a developer image on a recording medium.

26 Claims, 15 Drawing Sheets

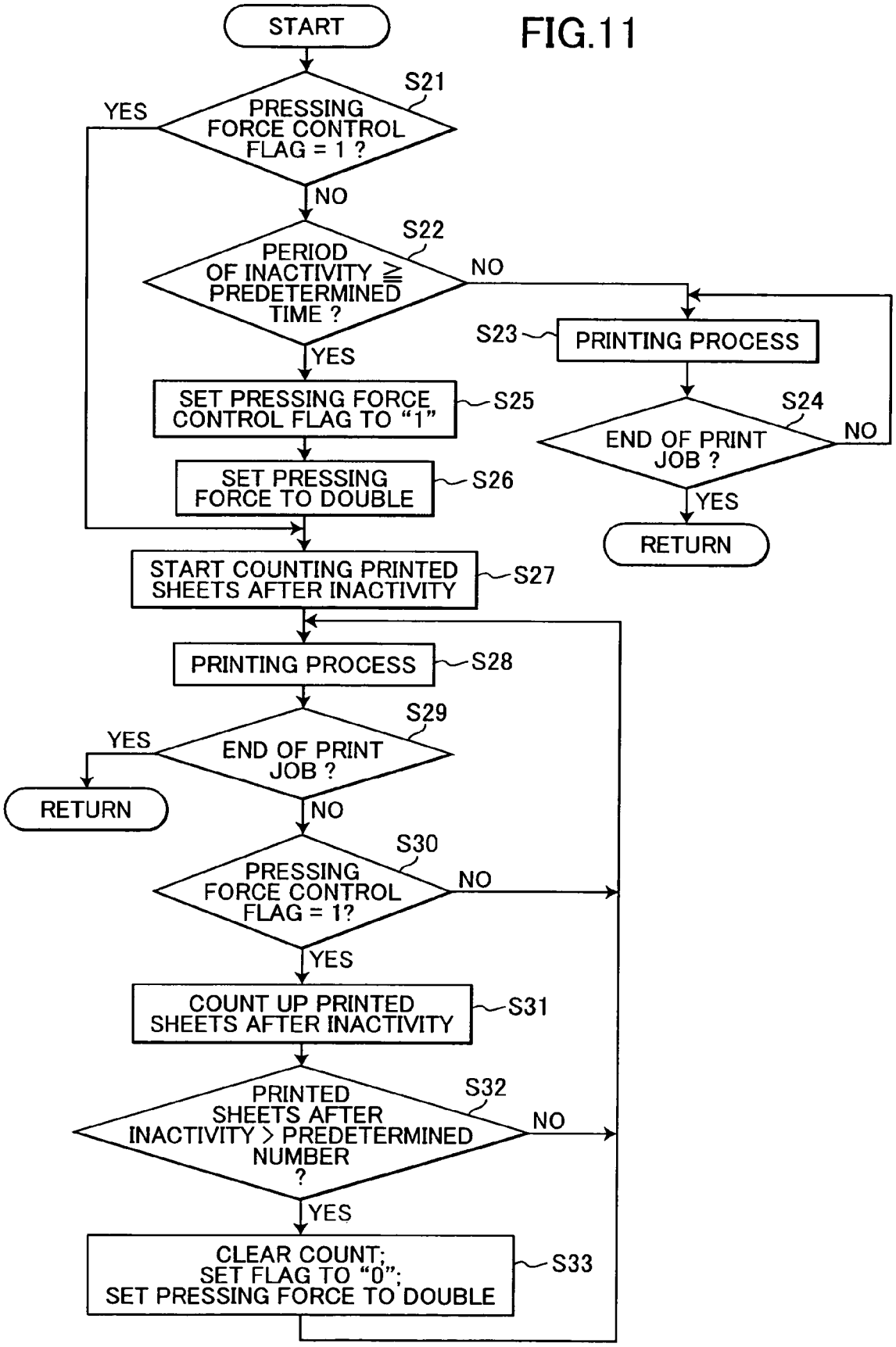
FIG.11
START
S21
PRESSING FORCE CONTROL FLAG = 1 ?
YES
NO
S22
PERIOD OF INACTIVITY ≧ PREDETERMINED TIME ?
NO
YES
S23
PRINTING PROCESS
S24
END OF PRINT JOB ?
NO
YES
RETURN
SET PRESSING FORCE CONTROL FLAG TO "1"
S25
SET PRESSING FORCE TO DOUBLE
S26
START COUNTING PRINTED SHEETS AFTER INACTIVITY
S27
PRINTING PROCESS
S28
S29
END OF PRINT JOB ?
YES
RETURN
NO
S30
PRESSING FORCE CONTROL FLAG = 1?
NO
YES
COUNT UP PRINTED SHEETS AFTER INACTIVITY
S31
S32
PRINTED SHEETS AFTER INACTIVITY > PREDETERMINED NUMBER ?
NO
YES
CLEAR COUNT; SET FLAG TO "0"; SET PRESSING FORCE TO DOUBLE
S33

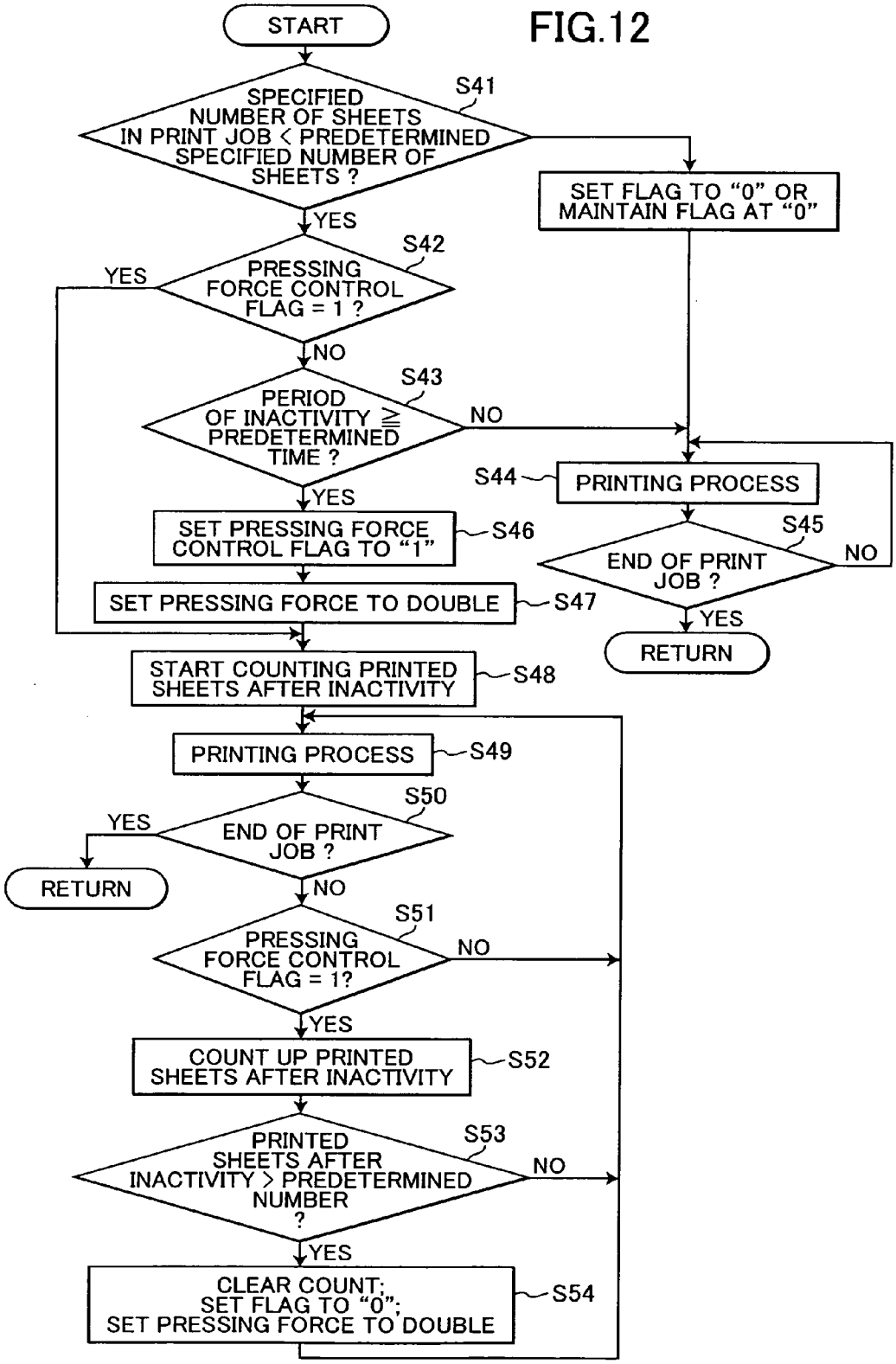
FIG.12
START
SPECIFIED NUMBER OF SHEETS IN PRINT JOB < PREDETERMINED SPECIFIED NUMBER OF SHEETS ?
S41
SET FLAG TO "0" OR MAINTAIN FLAG AT "0"
YES
PRESSING FORCE CONTROL FLAG = 1 ?
S42
YES
NO
PERIOD OF INACTIVITY ≧ PREDETERMINED TIME ?
S43
NO
YES
S44
PRINTING PROCESS
SET PRESSING FORCE CONTROL FLAG TO "1"
S46
END OF PRINT JOB ?
S45
NO
SET PRESSING FORCE TO DOUBLE
S47
YES
RETURN
START COUNTING PRINTED SHEETS AFTER INACTIVITY
S48
PRINTING PROCESS
S49
END OF PRINT JOB ?
S50
YES
RETURN
NO
PRESSING FORCE CONTROL FLAG = 1?
S51
NO
YES
COUNT UP PRINTED SHEETS AFTER INACTIVITY
S52
PRINTED SHEETS AFTER INACTIVITY > PREDETERMINED NUMBER ?
S53
NO
YES
CLEAR COUNT; SET FLAG TO "0"; SET PRESSING FORCE TO DOUBLE
S54

FIG.13

| PRINT JOB | INACTIVITY TIME | SPECIFIED NUMBER OF SHEETS IN PRINT JOB | FIRST CONTROL MODE | SECOND CONTROL MODE | THIRD CONTROL MODE |
|---|---|---|---|---|---|
| 1 | 5 HOURS | 20 | 1400 | 1400 | 1400 |
| 2 | 20 MINUTES | 3 | 700 | 700 | 700 |
| 3 | 10 MINUTES | 1 | 700 | 700 | 700 |
| 4 | 8 HOURS | 4 | 1400 | 1400 | 1400 |
| 5 | 5 MINUTES | 10 | 700 | 1400 | 1400 |
| 6 | 5 MINUTES | 8 | 700 | 1400(1～6)<br>700(7～8) | 1400(1～6)<br>700(7～8) |
| 7 | 10 MINUTES | 5 | 700 | 700 | 700 |
| 8 | 6 HOURS | 1 | 1400 | 1400 | 1400 |
| 9 | 3 HOURS | 2 | 700 | 1400 | 1400 |
| 10 | 20 MINUTES | 200 | 700 | 1400(1～17)<br>700(18～183) | 700 |
| 11 | 15 MINUTES | 3 | 700 | 700 | 700 |
| 12 | 6 HOURS | 30 | 1400 | 1400(1～20)<br>700(21～40) | 700 |

IMAGE FORMING DEVICE THAT ADJUSTS IMAGE DENSITY BASED ON DEVELOPING BIAS AND PRESSING FORCE

BACKGROUND OF THE INVENTION

1. Field of the Invention

The present invention relates to an image forming device such as a color laser printer, and a process cartridge mounted in the image forming device.

2. Description of Related Art

Conventional image forming devices such as laser printers normally include a process cartridge detachably mounted in the image forming device. The process cartridge includes a developing roller for bearing toner, and a photosensitive drum disposed in opposition to the developing roller. Electrostatic latent images are formed on the surface of the photosensitive drum.

In the developing process, a bias is applied to the developing roller, supplying toner from the developing roller to the photosensitive drum. The supplied toner develops an electrostatic latent image that has been formed on the photosensitive drum, producing a toner image thereon.

Subsequently, the toner carried on the photosensitive drum is transferred onto paper, forming an image on the paper.

It is known that as toner is consumed in these types of image forming devices, transmission density (base 10 logarithm of the inverse of the transmittance) of the toner image formed on the paper generally increases.

For this reason, as disclosed in Japanese patent-application publication No. HEI-9-311510, a technology for stabilizing changes in the density of a printed image has been proposed. In this technology, developing bias values that are optimal for various ambient temperatures and humidity, the accumulated number of sheets developed by developing devices, and the like are stored in a developing bias memory. The optimal developing biases for the conditions of use are read from the developing bias memory to control the power supply of the developing device according to the developing bias value.

SUMMARY OF THE INVENTION

However, if this type of image forming device is left inactive for a long period of time, the transmission density temporarily drops when printing for approximately one hundred pages after the period of inactivity.

Controlling the developing bias becomes very complex when attempting to account for the temporary drop in density following a period of inactivity by changing the developing bias, as described above. Specifically, when adjusting density after a period of inactivity only by changing the developing bias, it is necessary to store, in the developing bias memory, optimal developing bias values corresponding to ambient temperatures and humidity and also corresponding to the drop in density after inactivity. Hence, control associated with each value is needed, making control complex. In addition, this process leads to an increase in memory consumption, which can increase costs.

In view of the above-described drawbacks, it is an objective of the present invention to provide an image forming device with a simple construction that is capable of reliably adjusting densities to account for long-term and short-term changes in the density of a developer image. It is another object of the present invention to provide a process cartridge employed in the image forming device.

In order to attain the above and other objects, the present invention provides an image forming device. The image forming device includes a developer bearing member, a photosensitive member, a developing-bias applying portion, a pressing-force adjusting portion, and a density adjusting portion. The developer bearing member bears developer. The photosensitive member is disposed in contact with the developer bearing member. An electrostatic latent image is formed on the photosensitive member and developed by the developer supplied from the developer bearing member for forming a developer image. A pressing force is exerted between the developer bearing member and the photosensitive member. The developing-bias applying portion applies a developing bias to the developer bearing member. The pressing-force adjusting portion adjusts the pressing force between the developer bearing member and the photosensitive member. The density adjusting portion controls both the developing-bias applying portion and the pressing-force adjusting portion to adjust, based on adjustment of both the developing, bias and the pressing force, an amount of developer, in the developer image developed on the photosensitive member, thereby adjusting density of a developer image on a recording medium.

The present invention also provides a process cartridge. The process cartridge includes a developer bearing member and a photosensitive member. The developer bearing member bears developer. The photosensitive member is disposed in contact with the developer bearing member. An electrostatic latent image is formed on the photosensitive member and developed by the developer supplied from the developer bearing member for forming a developer image. The pressing force is exerted between the developer bearing member and the photosensitive member. The developer bearing member is disposed to press the photosensitive member by the pressing force adjusted by a pressing-force adjusting portion. The developer bearing member is applied with a developing bias by a developing-bias applying portion in order to adjust, in combination with the pressing force adjusted by the pressing-force adjusting portion, an amount of developer in the developer image developed on the photosensitive member, thereby adjusting density of a developer image on a recording medium.

The present invention also provides an image forming device. The image forming device includes a developer bearing member, a photosensitive member, an electrical density adjusting portion, a mechanical density adjusting portion, and a density adjusting portion. The developer bearing member bears developer. The photosensitive member is disposed in contact with the developer bearing member. An electrostatic latent image is formed on the photosensitive member and developed by the developer supplied from the developer bearing member for forming a developer image. The electrical density adjusting portion electrically adjusts an amount of developer in the developer image developed on the photosensitive member. The mechanical density adjusting portion mechanically adjusts the amount of developer in the developer image developed on the photosensitive member. The density adjusting portion controls both the electrical density adjusting portion and the mechanical density adjusting portion to adjust the amount of developer in the developer image developed on the photosensitive member, thereby adjusting density of a developer image on a recording medium.

BRIEF DESCRIPTION OF THE DRAWINGS

The above and other objects, features and advantages of the invention will become more apparent from reading the following description of the preferred embodiments taken in connection with the accompanying drawings in which:

FIG. 3(*b*) is a vertical cross-sectional view showing the process cartridge employed in the color laser printer of FIG. 1, in which the developing roller and the photosensitive drum are in a weak pressure state;

FIG. 3(*c*) is an enlarged horizontal cross-sectional view showing a pressing-force adjusting unit in the color laser printer of FIG. 1 in the strong pressure state;

FIG. 3(*d*) is an enlarged horizontal cross-sectional view showing the pressing-force adjusting unit in the color laser printer of FIG. 1 in the weak pressure state;

FIG. 3(*e*) is a side view showing a cam and a spring of the pressing-force adjusting unit in the color laser printer of FIG. 1 in the strong pressure state;

FIG. 3(*f*) is a side view showing the cam and the spring of the pressing-force adjusting unit in the color laser printer of FIG. 1 in the weak pressure state;

FIG. 11 is a flowchart showing an example of a second control mode in the short-term density adjusting program;

FIG. 12 is a flowchart showing an example of a third control mode in the short-term density adjusting program;

FIG. 13 is a table showing an example of data for the short-term density adjusting program;

FIG. 14(*b*) is a vertical cross-sectional view showing a process cartridge according to a second modification with a cam having a substantially windmill shape;

FIG. 16(*b*) is a side view showing the cam and the spring of the pressing-force adjusting unit according to the fourth modification in a weak pressure state.

DETAILED DESCRIPTION OF THE PREFERRED EMBODIMENTS

Figure 1:
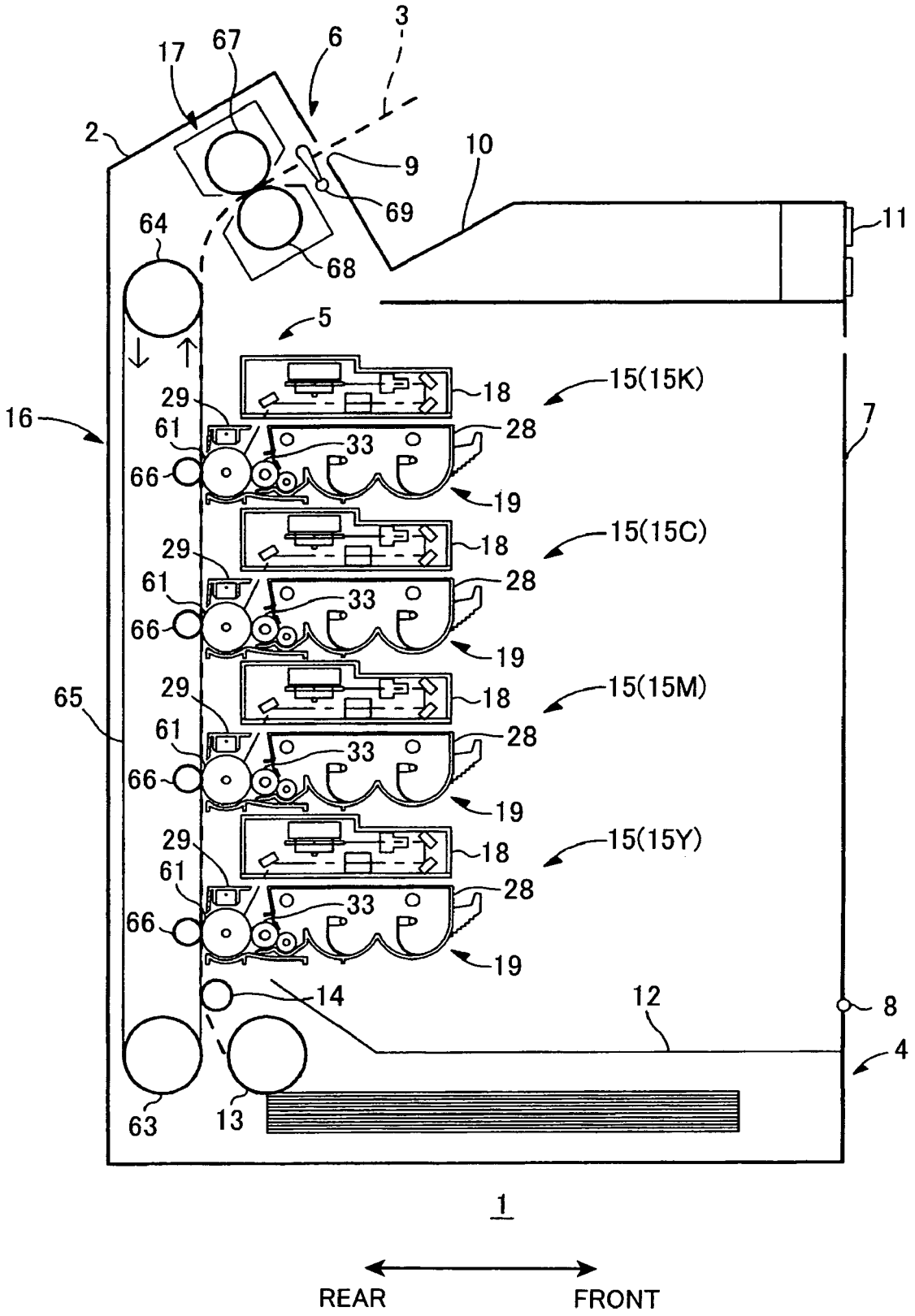
FIG. 1 is a vertical cross-sectional view showing a color laser printer according to an embodiment of the present invention.

An image forming device and a process cartridge according to embodiments of the present invention will be described while referring to the accompanying drawings wherein like parts and components are designated by the same reference numerals to avoid duplicating description.

FIG. 1 is a vertical cross-sectional view showing the relevant parts of a color laser printer according to an embodiment of the present invention.

As shown in FIG. 1, a color laser printer 1 includes a main casing 2 and, within the main casing 2, a paper supply unit 4 for supplying a paper 3, image forming units 5 for forming images on the paper 3 supplied from the paper supply unit 4, and a discharge unit 6 for discharging the paper 3 after images have been formed thereon by the image forming units 5.

The main casing 2 is formed substantially in a rectangular box shape. A front cover 7 is provided on the front side of the main casing 2 (hereinafter, the front side refers to the front side of the printer 1 on which a control panel 11 described later is disposed, while the rear side is is the side on which a transfer unit 16 described later is disposed). The lower edge of the front cover 7 is rotatably supported on the main casing 2 via a hinge 8 and is capable of opening and closing on the main casing 2.

The top region of the main casing 2 includes a discharge opening 9 through which the paper 3 is discharged, and a discharge tray 10 having a depression that grows deeper toward the discharge opening 9 for stacking the paper 3 that is discharged through the discharge opening 9.

A control panel 11 is disposed on the front end of the main casing 2 below the discharge tray 10 for controlling the printer 1.

The paper supply unit 4 includes a paper tray 12 detachably mounted in the lower section of the main casing 2 for accommodating stacked sheets of the paper 3 and capable of being inserted and removed through the front of the main casing 2 in a substantially horizontal direction, a feed roller 13 disposed in the upper rear end of the paper tray 12 for feeding sheets of paper accommodated in the paper tray 12, and a conveying roller 14 disposed above the feed roller 13 and upstream than a yellow image forming unit 15Y in the conveying direction of a conveying belt 65 for conveying sheets of the paper 3 supplied from the feed roller 13.

When the paper 3 is stacked in the paper tray 12 and the feed roller 13 rotates, the topmost sheet of the paper 3 is fed by the rotation of the feed roller 13 one sheet at a time toward the conveying roller 14 in a direction that is substantially vertically upward. The paper 3 is conveyed sequentially from the conveying roller 14 between the conveying belt 65 and photosensitive drums 61 (transfer position).

The image forming units 5 includes single-color image forming units 15, a transfer unit 16, and a fixing unit 17.

One of the image forming units 15 is provided for each of the four colors being printed. Hence, the image forming units 15 include a yellow image forming unit 15Y, a magenta image forming unit 15M, a cyan image forming unit 15C, and a black image forming unit 15K. The image forming units 15 are arranged from bottom to top in the order given above and are separated at predetermined intervals. Hence, the image forming units 15 are arranged parallel to one another and stacked in a substantially vertical direction.

Each of the image forming units 15 includes a scanning unit 18 and a process cartridge 19. Each scanning unit 19 is disposed above a developing cartridge 28 and separated a predetermined distance from the conveying belt 65 in a substantially horizontal direction. The scanning units 18 are fixed to the main casing 2.

Figure 2:
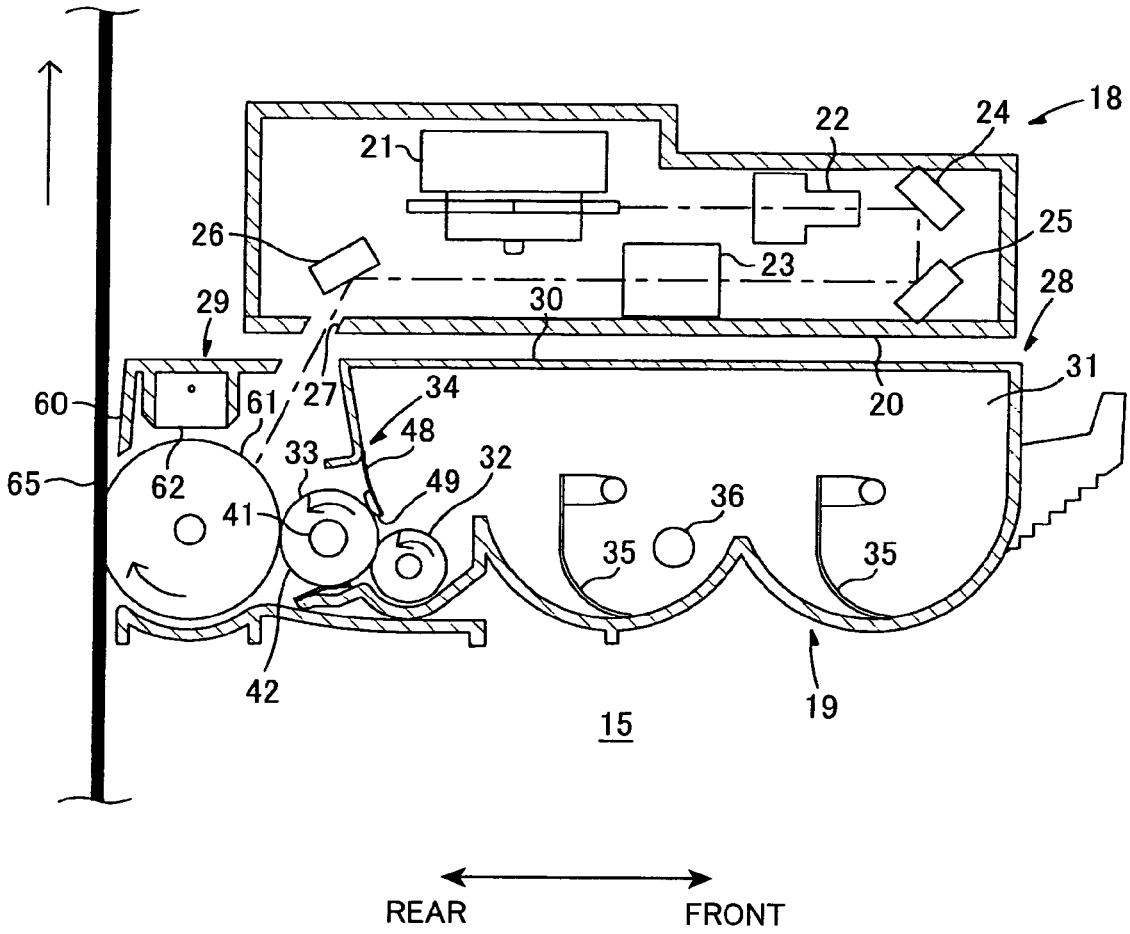
FIG. 2 is a vertical cross-sectional view showing a single-color image forming unit employed in the color laser printer of FIG. 1.
Figure 3A:
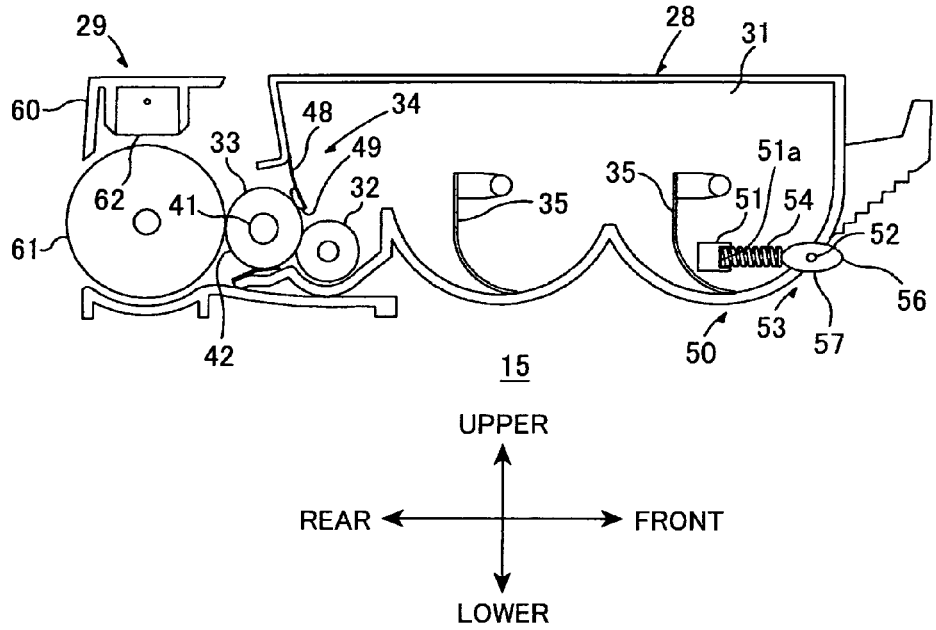
FIG. 3(*a*) is a vertical cross-sectional view showing a process cartridge employed in the color laser printer of FIG. 1, in which a developing roller and a photosensitive drum are in a strong pressure state.
Figure 3B:
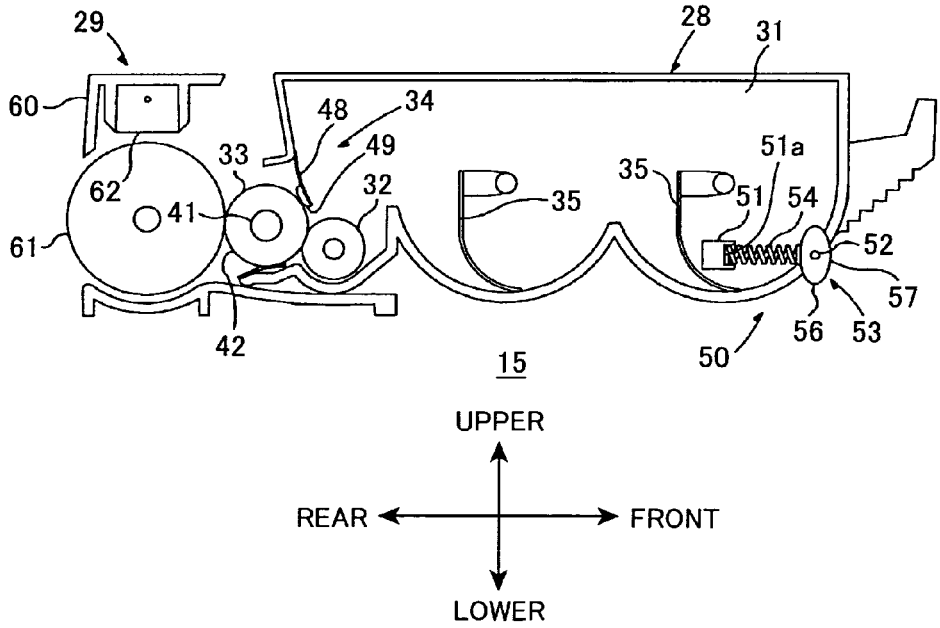
Figure 3C:
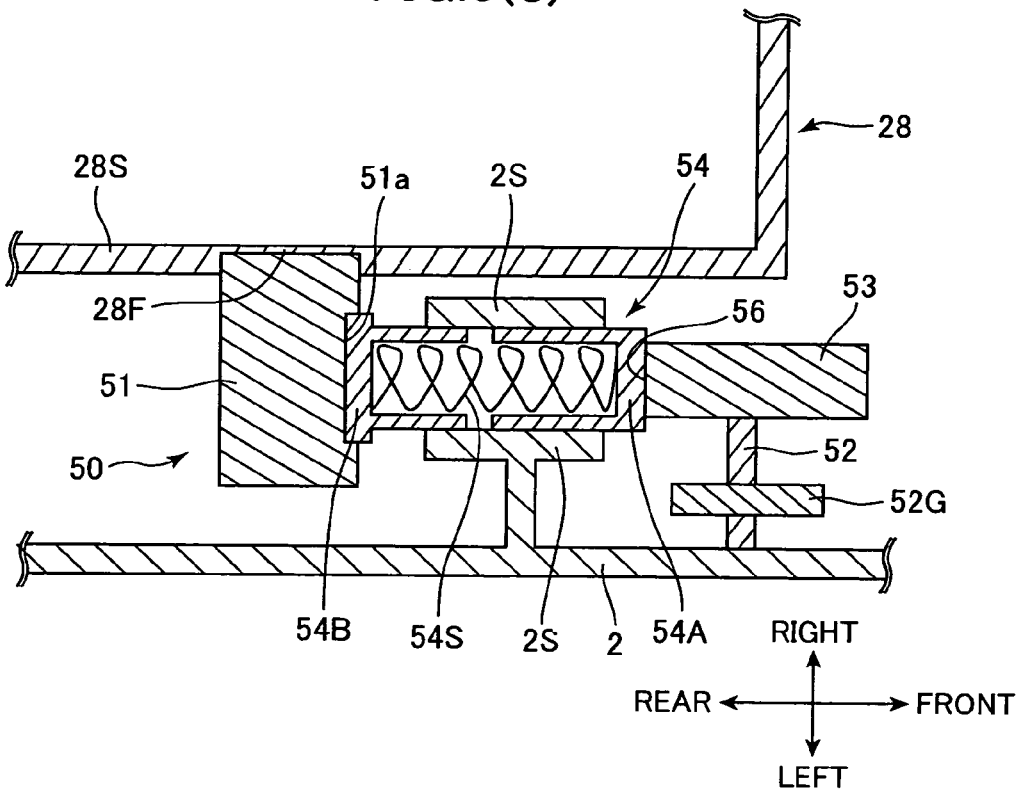
Figure 3D:
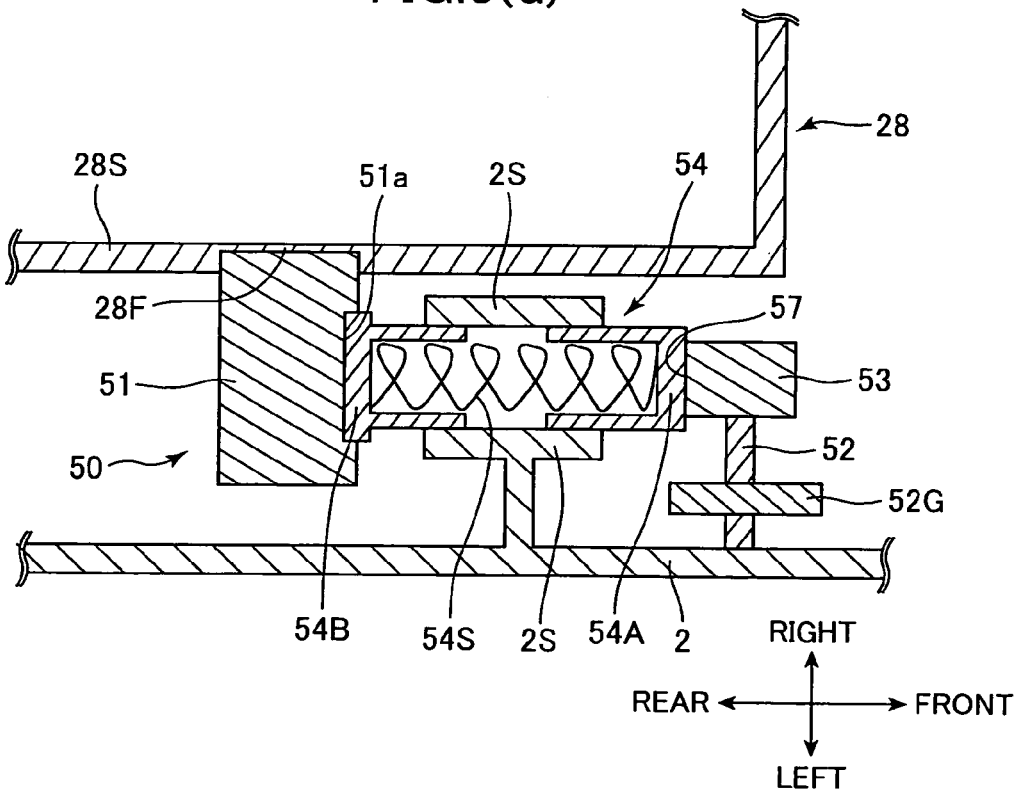
Figure 3E:
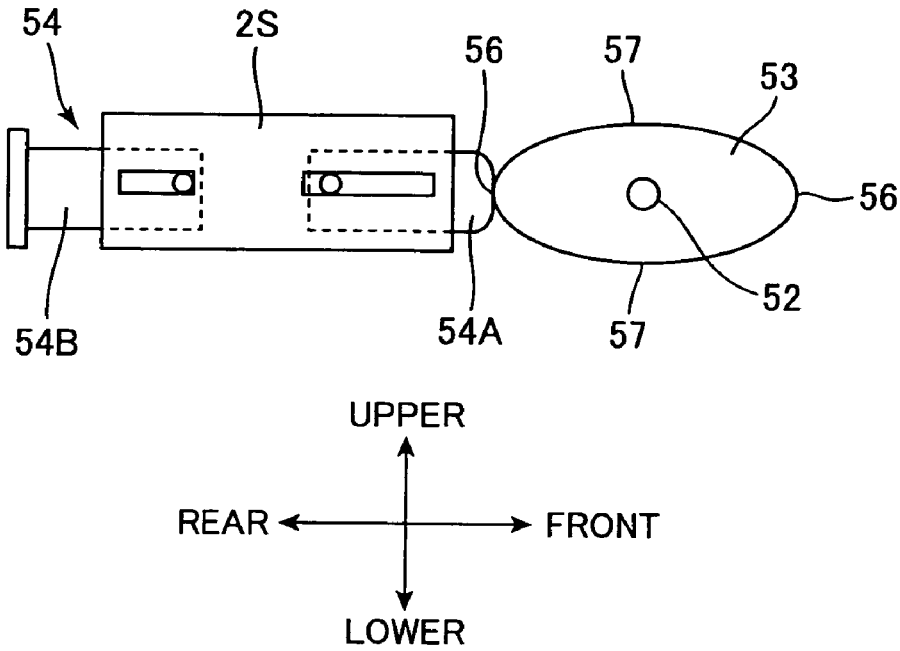
Figure 3F:
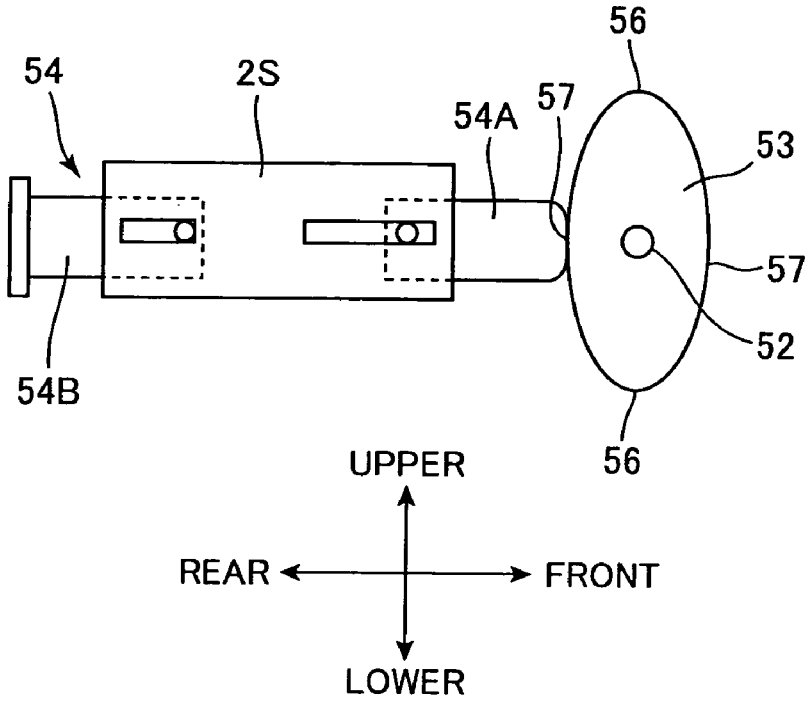

As shown in FIG. 2, the scanning unit 19 includes a casing 20 and, within the casing 20, a laser emitting portion (not shown), a polygon mirror 21, two lenses 22 and 23, and three reflecting mirrors 24, 25, and 26. A window 27 through which the laser beam passes is formed in the bottom surface of the casing 20 near the rear end.

With the scanning unit 18 having this construction, a laser beam (indicated by the broken line with alternating long and short dashes in FIG. 2) emitted from the laser emitting portion based on image data reflects off the polygon mirror 21 and is sequentially passed through or reflected by the lens 22, reflecting mirror 24, reflecting mirror 25, lens 23, and reflecting mirror 26 to be irradiated through the window 27. After passing through the window 27, the laser beam is irradiated in a high-speed scanning motion over the surface of the photosensitive drum 61.

The process cartridge 19 is disposed below each of the scanning units 18 and is detachably mounted in the main casing 2.

Each of the process cartridges 19 includes the developing cartridge 28, and a drum cartridge 29. The developing cartridge 28 is disposed in the front area, and the drum cartridge 29 in the rear area of the process cartridge 19. The developing cartridge 28 is detachably mounted on the drum cartridge 29.

The developing cartridge 28 includes a casing 30, and, within the casing 30, a toner hopper 31, a supply roller 32, a developing roller 33, and a thickness regulating blade 34.

As shown in FIG. 2, the toner hopper 31 is formed by the interior space of the casing 30. Two agitators 35 are disposed in the toner hopper 31 and arranged substantially in a horizontal direction, while being separated by a predetermined distance. Each of the toner hoppers 31 accommodates toner for each color. More specifically, each toner hopper 31 accommodates a nonmagnetic, positively charged, single-component polymer toner for each image forming unit 15 with the color yellow in the yellow image forming unit 15Y, magenta in the magenta image forming unit 15M, cyan in the cyan image forming unit 15C, and black in the black image forming unit 15K. This type of polymer toner is manufactured by suspension polymerization or emulsion polymerization, forming particles with a substantially spherical shape that have excellent fluidity.

Windows 36 for detecting the amount of remaining toner are provided in both side walls of the casing 30, opposing each other across the toner hopper 31 in the widthwise direction (a direction perpendicular to the sheet of drawing). An optical sensor 37, shown in FIG. 4, is on the outer sides of the windows 36 in the widthwise direction.

Figure 4:
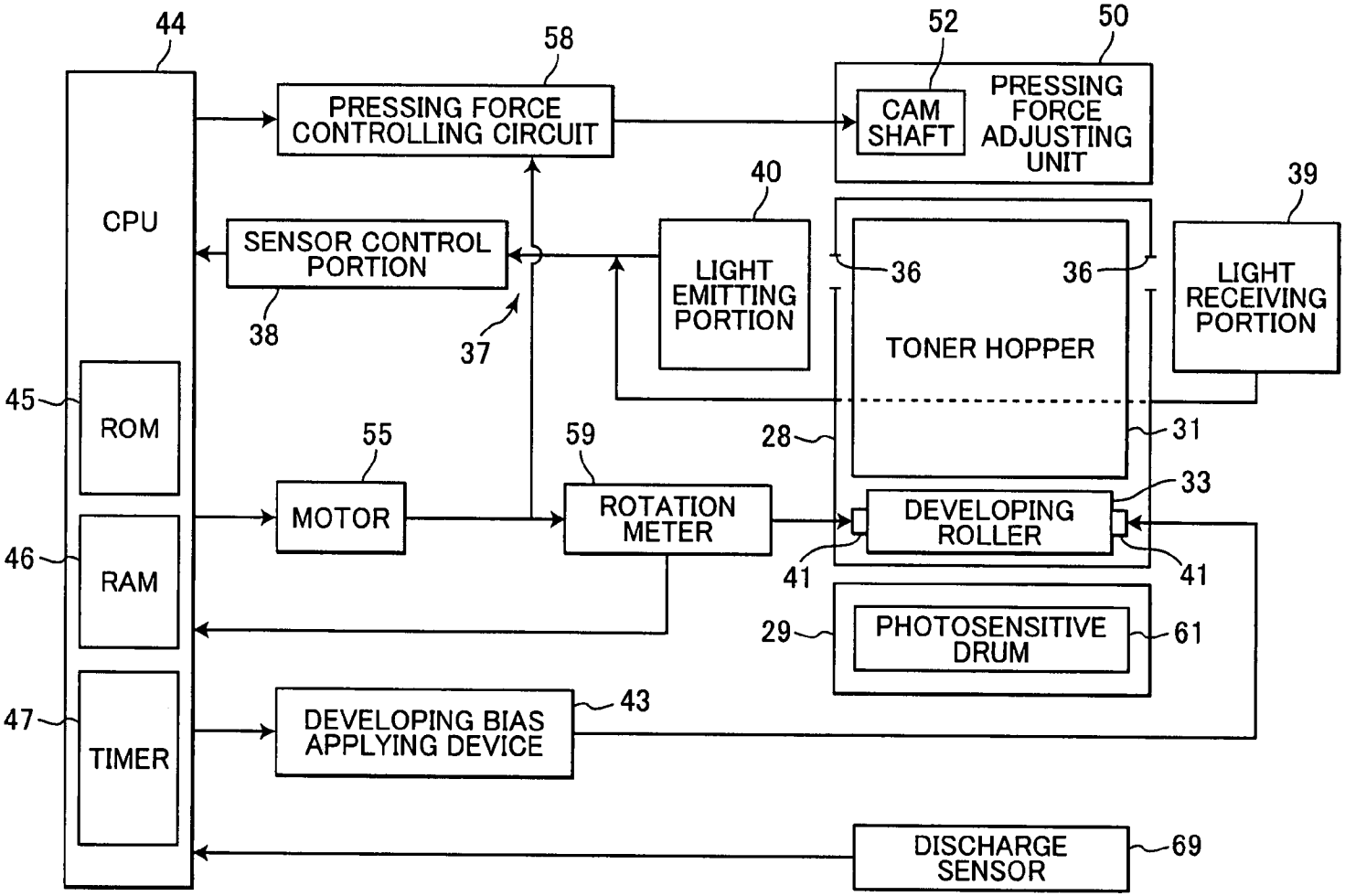
FIG. 4 is a block diagram showing a control system for implementing a density adjusting program.

More specifically, as shown in FIG. 4, the optical sensor 37 is disposed inside the main casing 2 and includes a sensor control portion 36, a light receiving portion 39, and a light emitting portion 40. When the developing cartridge 28 is mounted in the main casing 2, the light receiving portion 39 and light emitting portion 40 are positioned outside each of the windows 36 in the widthwise direction and are connected to the sensor control portion 38.

With the optical sensor 37, the sensor control portion 38 measures the amount of transmitted light emitted from the light emitting portion 40 that passes through the windows 36 and is received by the light receiving portion 39. Since the amount of passed light increases as the remaining toner decreases, the amount of toner consumption can be detected. The optical sensor 37 is connected to a CPU 44.

As shown in FIG. 2, the supply roller 32 includes a metal roller shaft covered by a roller member that is formed of a conductive sponge material. The supply roller 32 is supported in the casing 30 and is capable of rotating in the counterclockwise direction in FIG. 2 so that the surface of the supply roller 32 moves opposite the surface of the developing roller 33 at the point of contact with the developing roller 33. The supply roller 32 is driven by a motor 55 (see FIG. 4) disposed in the main casing 2. The developing roller 33 is disposed behind the supply roller 32 and is exposed through the rear of the casing 30. The supply roller 32 and developing roller 33 are compressed against one another. The developing roller 33 is configured of a metal roller shaft 41 covered by a roller member 42 that is formed of a resilient material, such as a conductive rubber. More specifically, the roller member 42 of the developing roller 33 is formed in a two-layer construction having a resilient roller layer formed of an electrically conductive urethane rubber, silicon rubber, EPDM rubber, or the like including fine carbon particles; and a coating layer coating the surface of the roller layer and having the primary components urethane rubber, urethane resin, polyimide resin, and the like. The developing roller 33 is connected and driven by the motor 55 (FIG. 4) disposed in the main casing 2.

The developing roller 33 is rotatably supported in the casing 30 so as to rotate in the counterclockwise direction of FIG. 2, such that the surface of the developing roller 33 at the portion of contact with the photosensitive drum 61 moves in the same direction as the surface of the photosensitive drum 61.

As shown in FIG. 4, a rotation meter 59 is connected to the metal roller shaft 41 of the developing roller 33. When the developing cartridge 28 is mounted in the main casing 2, the rotation meter 59 is connected between the motor 55 and the metal roller shaft 41 for detecting the number of rotations of the metal roller shaft 41. The rotation meter 59 is also connected to the CPU 44, enabling the CPU 44 to calculate the accumulated number of rotations of the developing roller 33.

As shown in FIG. 4, a developing bias applying device 43 is connected to the metal roller shaft 41 for applying a developing bias to the developing roller 33.

The developing bias applying device 43 is disposed in the main casing 2 and connects with the metal roller shaft 41 via an electrode (not shown) when the developing cartridge 28 is mounted in the main casing 2. In the process of a density adjusting program described later, the developing bias applying device 43 applies a developing bias to the developing roller 33 based on control from the CPU 44. The developing bias applying device 43 is connected to the CPU 44 disposed in the main casing 2.

The CPU 44 controls each component including the developing bias applying device 43 and includes a ROM 45, RAM 46, and a timer 47. The ROM 45 stores various programs, including the density adjusting program for controlling a pressing-force adjusting unit 50 described later and the developing bias applying device 43. The RAM 46 temporarily stores various values used when executing the various programs.

During a developing operation, the CPU 44 controls the developing bias applying device 43 to apply a developing bias to the metal roller shaft 41.

As shown in FIG. 2, the thickness regulating blade 34 also includes a metal leaf spring member 48 and a pressing member 49 having a semicircular cross section and formed of an insulating silicon rubber that is disposed on the free end of the leaf spring member 48. The thickness regulating blade 34 is disposed above and between the supply roller 32 and developing roller 33 extending along the axis of the developing roller 33. The base end of the leaf spring member 48 is supported on the casing 30, while the pressing member 49 disposed on the free end of the leaf spring member 48 is placed in contact with the upper side surface of the developing roller 33 by the elastic force of the leaf spring member 48.

As the two agitators 35 rotate, toner accommodated in the toner hopper 31 is conveyed from the front to the rear of the toner hopper 31 and is supplied to the supply roller 32. The rotation of the supply roller 32 supplies toner to the developing roller 33, at which time the toner is positively tribo-charged between the supply roller 32 and developing roller 33. As the developing roller 33 rotates, toner supplied to the surface of the developing roller 33 passes through the developing roller 33 and the pressing member 49, thereby forming a thin layer of uniform thickness on the surface of the developing roller 33.

When mounted in the main casing 2, the developing cartridge 28 couples with the pressing-force adjusting unit 50 provided in the main casing 2.

As shown in FIGS. 3(*a*) through 3(*d*), the pressing-force adjusting unit 50 is disposed in confrontation with the front-lower end portion of both side walls 28S (FIGS. 3(*c*) and 3(*d*)) of the developing cartridge 28. The pressing-force adjusting unit 50 includes a spring receiving portion 51, a cam shaft 52, a cam 53, a spring 54, and a pressing-force controlling circuit 58 (FIG. 4). Note that a couple of the pressing-force adjusting units 50 is provided on each of both side walls 28S for each image forming unit 15, although only one pressing-force adjusting unit 50 is shown in FIGS. 3(*a*) through 3(*d*).

The spring receiving portion 51 has a cross section shaped substantially like a three-sided box having a concave portion 51*a* that is opened, toward the front for receiving the spring 54 in a substantially horizontal direction. As shown in FIGS. 3(*c*) and 3(*d*), the spring receiving portion 51 is fixed to both side walls 28S of the developing cartridge 28. The spring receiving portion 51 can receive the spring 54, when the developing cartridge 28 is mounted in the main casing 2. A fitting portion 28F for fitting with the spring receiving portion 51 is formed in both side walls 28S of the developing cartridge 28.

As shown in FIGS. 3(*c*) and 3(*d*), the cam shaft 52 is rotatably supported in the main casing 2 in the front of and separated a predetermined distance from the spring receiving portion 51. A gear 52G is fixedly provided on the cam shaft 52, such that the cam shaft 52 rotates together with the gear 52G. As shown in FIG. 4, the motor 55 disposed in the main casing 2 is connected to the cam shaft 52 (more specifically, to the gear 52G) via the pressing-force controlling circuit 58. The motor 55 generates and transmits a driving force to the gear 52G and to the cam shaft 52. The CPU 44 is connected to the motor 55.

As shown in FIGS. 3(*a*) through 3(*d*), the cam 53 is disposed in a position confronting the spring receiving portion 51 in the front-to-rear direction and is fixed to the cam shaft 52. In other words, the cam 53 is not capable of rotating relative to the cam shaft 52.

As shown in FIGS. 3(*e*) and 3(*f*), the cam 53 is formed in an elliptical shape including a long radius portion 56 that is long in the latitudinal direction and a short radius portion 57 that is shorter than the long radius portion 56.

As shown in FIGS. 3(*a*) and 3(*b*), the spring 54 is disposed substantially in a horizontal orientation between the spring receiving portion 51 and the cam 53. As shown in FIGS. 3(*c*) and 3(*d*), the spring 54 includes a front sliding member 54A, a rear sliding member 54B, and a spring member 54S. The main casing 2 is formed with a spring support portion 2S for slidingly supporting the front sliding member 54A and the rear sliding member 54B. That is, each of the front sliding member 54A and the rear sliding member 54B is slidingly movable with regard to the spring support portion 2S. The rear sliding member 54B is received by the spring receiving portion 51, while the front sliding member 54A contacts the peripheral surface of the cam 53, and the spring member 54S is interposed in a compressed state between the front sliding member 54A and the rear sliding member 54B. With this construction, an urging force of the spring 54 urges the spring receiving portion 51 toward the rear, and is transmitted to the developing cartridge 28. That is, the urging force of the spring 54 urges the developing cartridge 28 toward the drum cartridge 29.

As shown in FIG. 4, the pressing-force controlling circuit 58 is interposed between the cam shaft 52 and motor 55 and controls the rotational angle of the cam shaft 52.

The CPU 44 controls the pressing-force controlling circuit 58 to control the rotational angle of the cam shaft 52 in the pressing-force adjusting unit 50. The cam 53 continuously changes the urging force of the spring 54 from a strong pressure state at which the long radius portion 56 of the cam 53 contacts the spring 54, as shown in FIGS. 3(*a*), 3(*c*), and 3(*e*), to a weak pressure state at which the short radius portion 57 of the cam 53 contacts the spring 54, as shown in FIGS. 3(*b*), 3(*d*), and 3(*f*).

Specifically, in the strong pressure state shown in FIGS. 3(*a*), 3(*c*), and 3(*e*), the long radius portion 56 of the cam 53 contacts the spring 54 (more specifically, the front sliding member 54A) so that the distance between the long radius portion 56 and the spring receiving portion 51 is less than during the weak pressure state, thereby increasing the compression of the spring member 54S. Accordingly, the spring receiving portion 51 is strongly urged by the spring 54, pressing the developing cartridge 28 strongly against the drum cartridge 29 toward the rear direction. Consequently, the pressing force of the developing roller 33 on the photosensitive drum 61 is relatively large.

In the weak pressure state shown in FIGS. 3(*b*), 3(*d*), and 3(*f*), the short radius portion 57 of the cam 53 contacts the spring 54 (more specifically, the front sliding member 54A) so that the distance between the short radius portion 57 and the spring receiving portion 51 is greater than during the strong pressure state, thereby decreasing the compression of the spring member 54S. Accordingly, the spring receiving portion 51 is weakly urged by the spring 54 so that the developing cartridge 28 presses against the drum cartridge 29 weakly. As a result, the pressing force of the developing roller 33 on the photosensitive drum 61 is relatively small.

With the printer 1 of this construction, the pressing force of the developing roller 33 on the photosensitive drum 61 during the strong pressure state (in other words, an upper limit of the pressing force) is set to a force smaller than a pressing force (2000×9.8 mN, for example) that produces fogging on the paper 3 when a toner image is transferred from the photosensitive drum 61 onto the paper 3. Fogging is determined to have been generated when whiteness degree of the paper 3 (ΔY value=(reflectance of normal white background)−(reflectance of white background containing fogging)) measured by a reflectance densitometer (such as the densitometer manufactured by Tokyo Denshoku Gijutsu Center) is 5 or more.

The pressing force of the developing roller 33 on the photosensitive drum 61 in the weak pressure state (in other words, a lower limit of the pressing force) is set to a force greater than a pressing force (400×9.8 mN, for example) at which the roller member 42 of the developing roller 33 no longer contacts the photosensitive drum 61 evenly (with uniform pressure) across the entire axial direction of the photosensitive drum 61.

Hence, in the printer 1, control of the pressing-force controlling circuit 58 by the CPU 44 can adjust the pressing force of the developing roller 33 on the photosensitive drum 61 at any pressing force within a range from the strong pressure state (2000×9.8 mN, for example) to the weak pressure state (400×9.8 mN, for example).

Accordingly, although FIGS. 3(*a*) through 3(*f*) show only the strong pressure state and the weak pressure state, any pressure state between the strong pressure state and the weak pressure state can be achieved by controlling the rotational angle of the cam shaft 52. In the present embodiment, the CPU 44 and the pressing-force controlling circuit 58 (FIG. 4) controls the rotational angle of the cam shaft 52 to achieve the pressing forces of 500×9.8 mN, 600×9.8 mN, 700×9.8 mN, 1000×9.8 mN, 1200×9.8 mN, and 1400×9.8 mN, as described later.

By adjusting the pressing force of the developing roller 33 on the photosensitive drum 61 within this range, that is, within a range greater than a pressing force at which contact is no longer uniform and less than a pressing force that generates fogging on the paper 3, the printer 1 can adjust density during the process of the density adjusting program at a uniform density, while reducing fogging.

Further, by setting the lower limit of the pressing force to 400×9.8 mN and the upper limit of the pressing force to 2000×9.8 mN, that is, smaller than the pressing force at which the ΔY value of the paper 3 measured by the reflectance densitometer exceeds 5, the density can be adjusted at a uniform density while reducing fogging.

Further, the pressing-force adjusting unit 50 can be configured at a low cost with such simple components as the cam 53 and spring 54. By switching the urging force of the spring 54 with the cam 53, the pressing-force adjusting unit 50 can change the pressing force of the developing roller 33 on the photosensitive drum 61. Hence, the pressing-force adjusting unit 50 can easily and reliably change the pressing force of the developing roller 33 on the photosensitive drum 61.

Since the spring 54 urges the developing cartridge 28 toward the drum cartridge 29, the pressing-force adjusting unit 50 can ensure that the developing roller 33 is reliably urged against the photosensitive drum 61.

As shown in FIG. 2, the drum cartridge 29 is detachably mounted in the main casing 2 so that the photosensitive drum 61 and a Scorotron type charger 62 are provided in a drum casing 60.

The photosensitive drum 61 is configured of a cylindrical metal tube formed of aluminum or the like, the surface of which is coated with a photosensitive layer. The photosensitive layer is formed of an organic photosensitive material having the primary component of polycarbonate. The photosensitive drum 61 is rotatably supported in the drum casing 60 with both front and rear sides exposed from the drum casing 60. The photosensitive drum 61 rotates clockwise in FIG. 2 so that the surface of the photosensitive drum 61 moves in the same direction as the surface of the conveying belt 65 at the point of contact between the two.

The Scorotron type charger 62 is fixed to the drum casing 60 at a position above and separated a predetermined distance from the photosensitive drum 61. The Scorotron type charger 62 is a positive charging Scorotron charger having a charging wire formed of tungsten or the like from which a corona discharge is generated. The Scorotron type charger 62 functions to charge the entire surface of the photosensitive drum 61 with a uniform positive polarity.

When the developing cartridge 28 is mounted on the drum cartridge 29, the developing roller 33 is positioned in opposition to and in contact with the front side of the photosensitive drum 61, and the pressing-force adjusting unit 50 generates a desired pressing force between the developing roller 33 and photosensitive drum 61, as described above. Further, when the drum cartridge 29 is mounted in the main casing 2, the conveying belt 65 is positioned opposing and in contact with the rear side of the photosensitive drum 61.

As the photosensitive drum 61 rotates, the Scorotron type charger 62 generates a positive charge across the entire surface of the photosensitive drum 61. Subsequently, the surface of the photosensitive drum 61 is exposed to the high-speed scanning of a laser beam emitted from the scanning unit 18 as the photosensitive drum 61 rotates, forming electrostatic latent images on the surface of the photosensitive drum 61 based on predetermined image data. Next, the positively charged toner carried on the surface of the developing roller 33 is brought into contact with the photosensitive drum 61 as the developing roller 33 rotates. At this time, the latent images formed on the surface of the photosensitive drum 61 are transformed into visible images when the toner is selectively attracted to portions of the photosensitive drum 61 that were exposed to the laser beam and, therefore, have a lower potential than the rest of the surface having a uniform positive charge. In this way, a reverse image is formed. Through this process, a toner image of each color is formed on the photosensitive drum 61.

As shown in FIG. 1, the transfer unit 16 is disposed in the main casing 2 opposing each of the photosensitive drums 61 stacked in a substantially vertical direction on the opposite side from the developing cartridge 28 with regard to the photosensitive drums 61. The transfer unit 16 includes a belt drive roller 63, a belt follow roller 64, the conveying belt 65 configured of an endless belt, and transfer rollers 66.

The belt drive roller 63 is disposed below the photosensitive drum 61 of the yellow image forming unit 15Y and behind the feed roller 13. The belt follow roller 64 is disposed above the photosensitive drum 61 of the black image-forming unit 15K and diagonally below and behind the fixing unit 17.

The conveying belt 65 is composed of an electrically conducting polycarbonate, polyimide, or other resin with dispersed conductive particles such as carbon. The conveying belt 65 is looped around the belt drive roller 63 and the belt follow roller 64. The conveying belt 65 is disposed such that the contact surface on the outer side opposes and contacts the photosensitive drum 61 in each image forming unit 15.

The belt drive roller 63 drives and the belt follow roller 64 follows the driving of the belt drive roller 63, so that the conveying belt 65 circulates in a counterclockwise direction around the belt drive roller 63 and belt follow roller 64 and the surface of the conveying belt 65 moves in the same direction as the surface of each photosensitive drum 61 at the point of contact between the conveying belt 65 and the photosensitive drums 61.

Each of the transfer rollers 66 is disposed on the inside of the conveying belt 65 opposing the photosensitive drum 61 of the corresponding image forming unit 15 through the conveying belt 65 in a substantially horizontal direction. Each transfer roller 66 is formed of a metal roller shaft that is coated with a roller member formed of a resilient material such as an electrically conductive rubber material. The transfer roller 66 is capable of rotating in the counterclockwise direction in FIG. 1, so that the surface of the transfer roller 66 moves in the same direction as the movement of the conveying belt 65 at the contact surface in which the transfer roller 66 contacts the conveying belt 65. During a transfer operation, a transfer bias is applied to the transfer rollers 66 from a power source (not shown).

Hence, the paper 3 supplied from the paper supply unit 4 is guided upward by the conveying roller 14 so as to pass sequentially between the photosensitive drum 61 of each image forming unit 15 and the conveying belt 65 that circulates by the driving of the belt drive roller 63 and the following of the belt follow roller 64. A toner image in each color formed on the photosensitive drum 61 of each image forming unit 15 is transferred onto the paper 3 as the paper 3 passes between the respective photosensitive drum 61 and the conveying belt 65, thereby forming a color image on the paper 3.

For example, after a yellow toner image formed on the photosensitive drum 61 in the yellow image forming unit 15Y is transferred to the paper 3, next a magenta toner image formed on the photosensitive drum 61 of the magenta image forming unit 15M is transferred onto the paper 3 and superimposed over the yellow toner image that has already been transferred. Similarly, the cyan toner image formed in the cyan image forming unit 15C and the black toner image formed in the black image forming unit 15K are also transferred onto the paper 3 and superimposed over the existing images to form a color image thereon.

Since the printer 1 has a tandem structure provided with the photosensitive drum 61 for each color to form color images in this way, toner images of each color can be formed at about the same speed required to form a monochrome image, thereby achieving rapid color image formation.

The fixing unit 17 is disposed above the image forming units 15 and transfer unit 16 on the downstream end in the paper conveying direction. The fixing unit 17 includes a heating roller 67 and a pressure roller 68. The heating roller 67 is configured of a metal tube on the surface of which is formed a release layer. A halogen lamp extends in the axial direction of the heating roller 67 inside the metal tube. The halogen lamp heats the surface of the heating roller 67 to a fixing temperature. The pressure roller 68 is disposed in pressing contact with the heating roller 67.

The color image transferred onto the paper 3 is fixed by heat in the fixing unit 17 as the paper 3 passes between the heating roller 67 and the pressure roller 68.

The discharge unit 6 includes the discharge opening 9 and discharge tray 10 described above, as well as a discharge sensor 69. After the image on the paper 3 is fixed by heat, the paper 3 is discharged through the discharge opening 9 out of the main casing 2 and becomes stacked on top of the discharge tray 10.

The discharge sensor 69 is positioned facing the paper conveying path between the fixing unit 17 and the discharge opening 9. When the leading edge of the paper 3 being discharged through the discharge opening 9 contacts the discharge sensor 69, the discharge sensor 69 pivots toward the direction in which the paper 3 is passing. Further, when the trailing edge of the paper 3 separates from the discharge sensor 69, the discharge sensor 69 pivots back to its original state in a position blocking the paper 3. As shown in FIG. 4, the discharge sensor 69 is connected to the CPU 44. The CPU 44 detects the series of pivot operations of the discharge sensor 69 to count each sheet of the paper 3 that is discharged. For example, the CPU 44 calculates an accumulated number of printed sheets each time a new developing cartridge 28 is mounted in the main casing 2.

Figure 5:
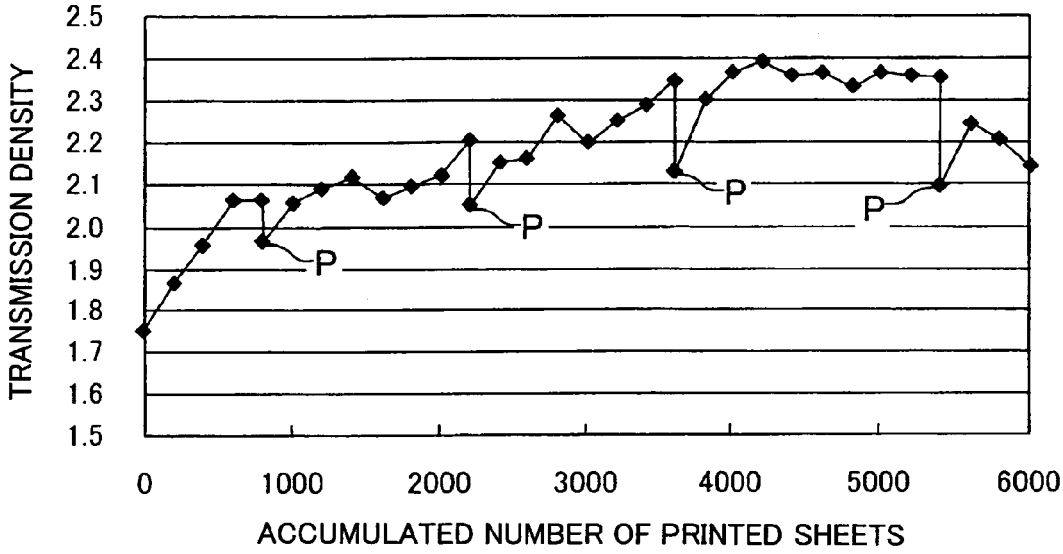
FIG. 5 is a graph showing the relationship between an accumulated number of printed sheets and transmission density.

As shown in FIG. 5, this type of printers generally exhibits a trend where, as toner is expended and the accumulated number of printed sheets increases, the transmission density (base 10 logarithm of the inverse of the transmittance) of the toner image formed on the paper 3 also tends to increase.

Figure 6:
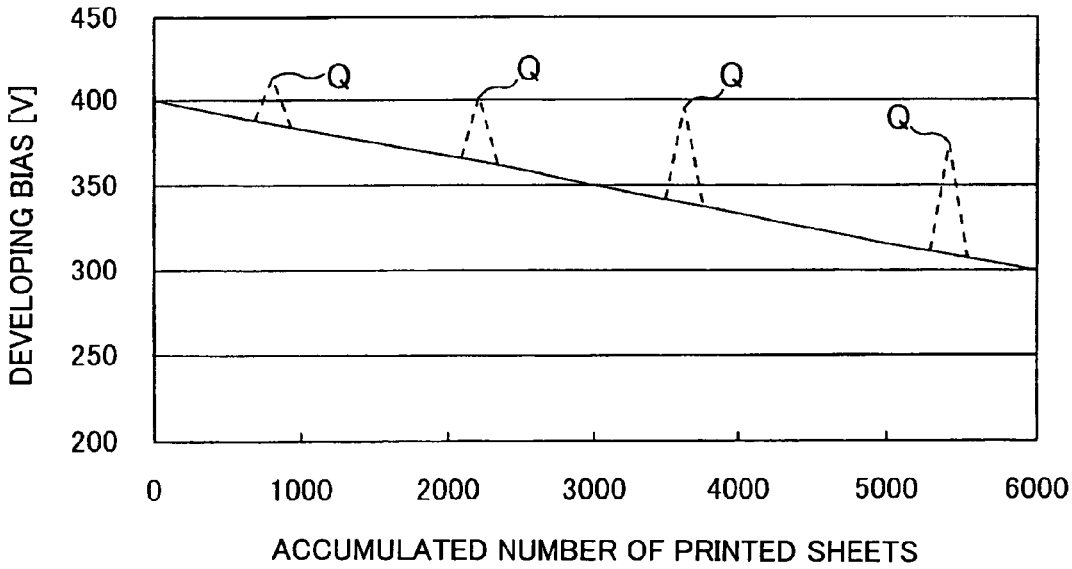
FIG. 6 is a graph showing the relationship between the accumulated number of printed sheets and a developing bias.

Hence, as shown in FIG. 6, in order to account for the increase in transmission density, the CPU 44 controls the developing bias applying device 43 to lower the developing bias as the accumulated number of printed sheets increases. By controlling the developing bias applying device 43 in this way, it is possible to compensate for the increase in transmission density over time and stabilize the transmission density.

However, if the printer 1 remains inactive for a long period of time and performs a printing operation after the inactivity, the transmission density temporarily drops for a period of about 100 sheets following the period of inactivity, as indicated by the points P in FIG. 5.

However, when attempting to account for the temporary drop in density following a period of inactivity by changing the developing bias, the developing bias must be raised sharply, as indicated by points Q in FIG. 6, making control extremely complex. Specifically, when accounting for adjustments in density following inactivity by changing the developing bias, it is necessary to store, in the developing bias memory, optimal developing bias values corresponding to ambient temperatures and humidity and also corresponding to the drop in density after inactivity, leading to increased memory consumption and a rise in costs. Further, performing control in association with these values to raise the developing bias sharply is extremely complex.

Figure 7:
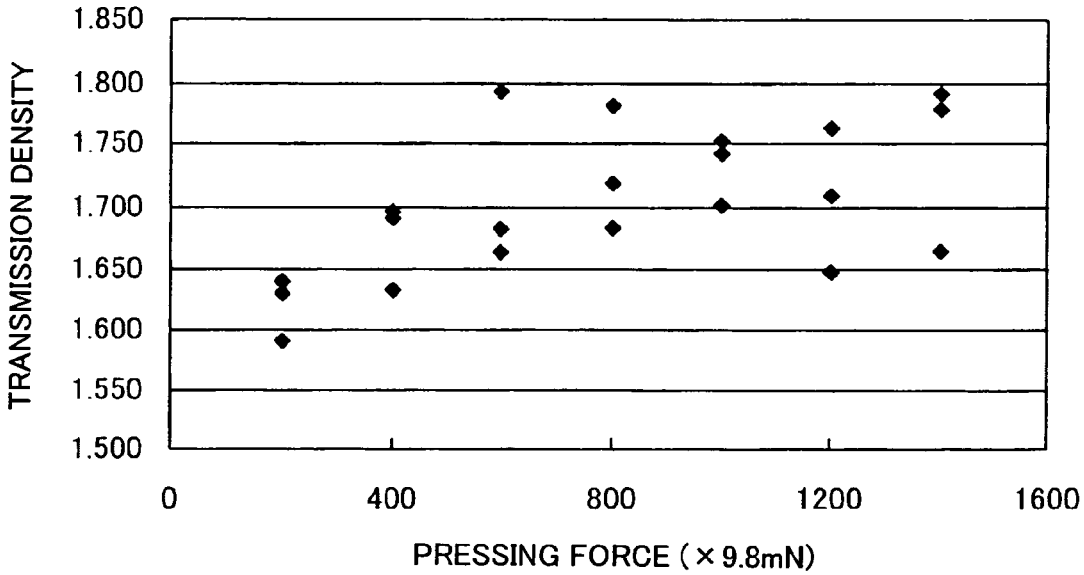
FIG. 7 is a graph showing the relationship between a pressing force and the transmission density.
Figure 8:
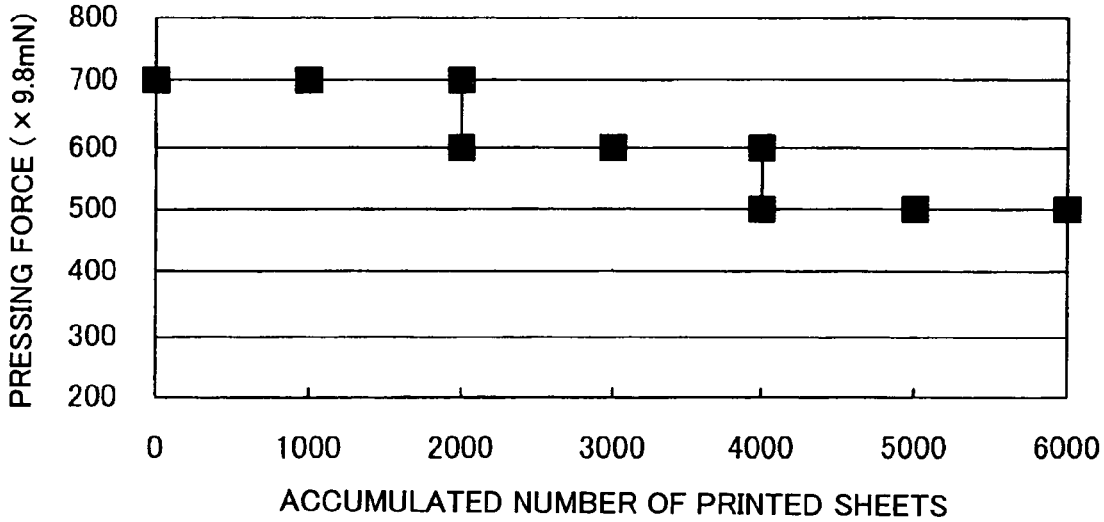
FIG. 8 is a graph showing the relationship between the accumulated number of printed sheets and the pressing force.

However, as shown in FIG. 7, when increasing the pressing force of the developing roller 33 on the photosensitive drum 61, the transmission density tends to increase. Accordingly, as shown in FIG. 8, the CPU 44 controls the pressing-force adjusting unit 50 to decrease the pressing force as the accumulated number of printed sheets increases, thereby compensating for the increase in transmission density over time. After an extended period of inactivity, the CPU 44 controls the pressing-force adjusting unit 50 to temporarily increase the pressing force in order to compensate for a temporary drop in transmission density.

Hence, with the printer 1 of the present embodiment, the CPU 44 controls the developing bias applying device 43 and the pressing-force adjusting unit 50 in order to adjust the amount of toner in a toner image developed on the photosensitive drum 61 and to adjust the density of the toner image formed on the paper 3 through a combination of the developing bias and pressing force, thereby compensating for an increase in density over time as toner is consumed and a temporary drop in density after a long period of inactivity.

Such compensation is implemented by the CPU 44 according to a process of the density adjusting program stored in the ROM 45. The density adjusting program includes a long-term density adjusting program for compensating for long-term changes in density, that is, increases in density over time as toner is consumed; and a short-term density adjusting program for compensating for short-term changes in density, that is temporary drops in density following long periods of inactivity.

Figure 9:
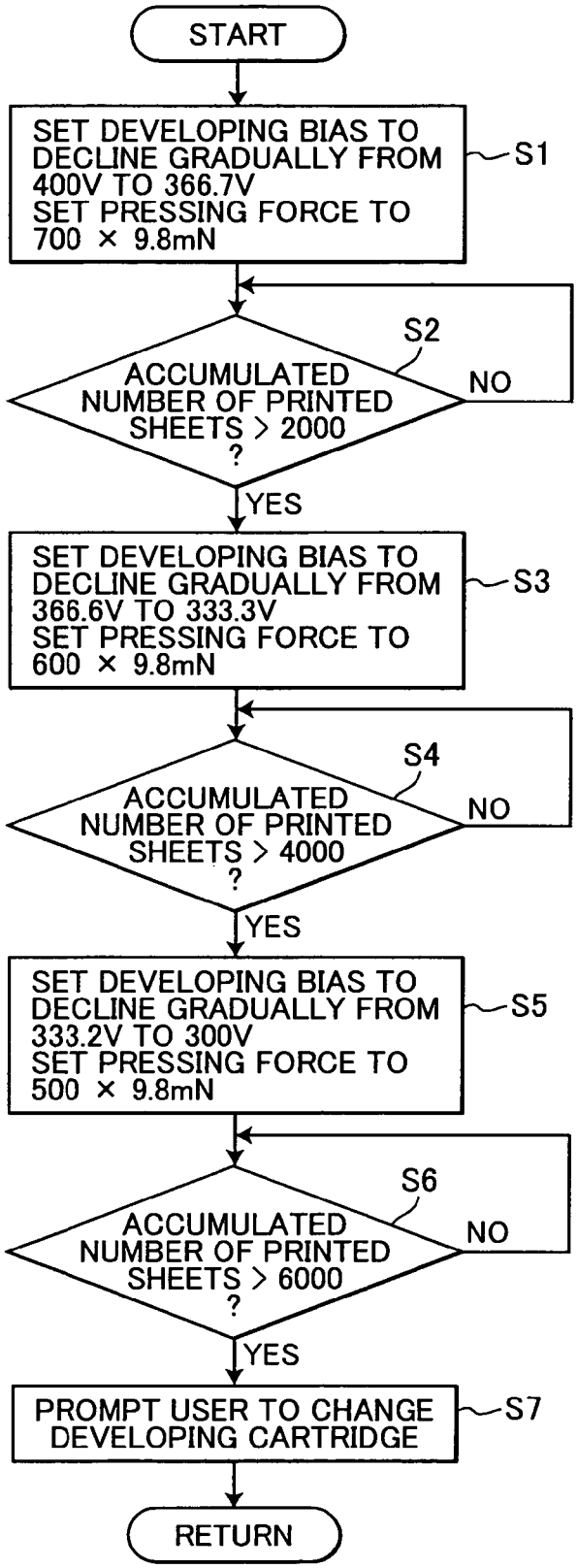
FIG. 9 is a flowchart showing an example of a long-term density adjusting program.

FIG. 9 is a flowchart illustrating steps in the long-term density adjusting program. Next, the steps in the long-term density adjusting program will be described with reference to FIG. 9.

In the process of FIG. 9, as indicated in FIG. 6, the developing bias is set to 400 V when printing the first sheet of paper and controlled to drop in 256 steps from 400 V to 300 V when printing the 6000th sheet. Further, as indicated in FIG. 8, the pressing force is set to 700×9.8 mN when printing the first sheet of paper and controlled to drop from 700×9.8 mN in three steps by 100×9.8 mN for each 2000 sheets. The toner hopper 31 of the developing cartridge 28 becomes empty when the accumulated number of printed sheets reaches 6000, assuming a printing coverage (a ratio A/B, where A is an area in which toner images are formed, and B is an entire area of paper) of 4% for a single color.

The process of FIG. 9 begins each time a new developing cartridge 2B is used; in other words, when a new printer 1 is first used or when the developing cartridge 28 is replaced. The beginning of the process is triggered by a sensor (not shown) detecting the mounting of the developing cartridge 28 or an operation performed on the control panel 11.

At the beginning of the process in step S1 ("step" is hereinafter abbreviated as "S"), the CPU 44 controls the developing bias applying device 43 to set the developing bias to gradually decline from 400 V to 366.7 V. The CPU 44 also controls the pressing-force adjusting unit 50, to set the pressing force to 700×9.8 mN.

In S2 the CPU 44 determines whether the accumulated number of printed sheets has exceeded 2000 sheets. If the accumulated number of printed sheets is less than or equal to 2000 (S2: NO), then the process loops back to S2. However, if the accumulated number of printed sheets exceeds 2000 (S2: YES), then in S3 the CPU 44 controls the developing bias applying device 43 to set the developing bias to decline gradually from 366.6 V to 333.3 V. The CPU 44 also controls the pressing-force adjusting unit 50 to set the pressing force to 600×9.8 mN.

In S4 the CPU 44 determines whether the accumulated number of printed sheets has exceeded 4000 sheets. If the accumulated number of printed sheets is less than or equal to 4000 (S4; NO), then the process loops back to S4. However, if the accumulated number of printed sheets exceeds 4000 (S4: YES), then in S5 the CPU 44 controls the developing bias applying device 43 to set the developing bias to decline gradually from 333.2 V to 300 V. The CPU 44 also controls the pressing-force adjusting unit 50 to set the pressing force to 500×9.8 mN.

In S6 the CPU 44 determines whether the accumulated number of printed sheets has exceeded 6000 sheets. If the accumulated number of printed sheets is less than or equal to 6000 (S6: NO), then the process loops back to S6. However, if the accumulated number of printed sheets exceeds 6000 (S6: YES), then the CPU 44 determines that the toner hopper 31 is empty and in S7 displays a message on the control panel 11 prompting the user to replace the developing cartridge 28, and the process ends.

In the process according to the long-term density adjusting program, the CPU 44 controls the developing bias applying device 43 to lower the developing bias and controls the pressing-force adjusting unit 50 to lower the pressing force according to the accumulated number of printed sheets. Accordingly, the printer 1 can suppress the generation of fogging while adjusting the density to compensate for long-term changes in density, that is, density increases over time accompanying the consumption of toner, thereby achieving image formation with a stable density over a long period.

In this process, the CPU 44 also changes the developing bias and pressing force according to the accumulated number of printed sheets counted by the discharge sensor 69. Hence, the printer 1 can easily and reliably adjust the density to compensate for density increases over time accompanying toner consumption.

In the process described above, the accumulated number of printed sheets is calculated based on detections by the discharge sensor 69. For convenience, the accumulated number of printed sheets is associated with the accumulated amount of toner required for developing toner images carried on the photosensitive drum 61. Hence, by calculating the accumulated number of printed sheets of the paper 3 in the above-described process, it is possible to achieve a simple and convenient measurement for the accumulated toner consumption and to control the developing bias and pressing force according to the measurement to achieve simple density adjustment.

Instead of the accumulated number of printed sheets calculated according to detections by the discharge sensor 69, the process described above can control the developing bias and pressing force according to the amount of toner consumption in the toner hopper 31 which is detected by the optical sensor 37, for example. By detecting the amount of toner consumption with the optical sensor 37, accumulated toner consumption can be measured accurately and density adjustment can be achieved accurately by controlling the developing bias and pressing force according to these measurements.

Further, instead of the accumulated number of printed sheets calculated according to detections by the discharge sensor 69, the developing bias and pressing force can be controlled according to an accumulated number of rotations calculated by detections of the rotation meter 59, for example. By detecting the accumulated number of rotations with the rotation meter 59, the accumulated toner consumption can be measured simply and density adjustment can be achieved simply by controlling the developing bias and pressing force according to these measurements.

Figure 10:
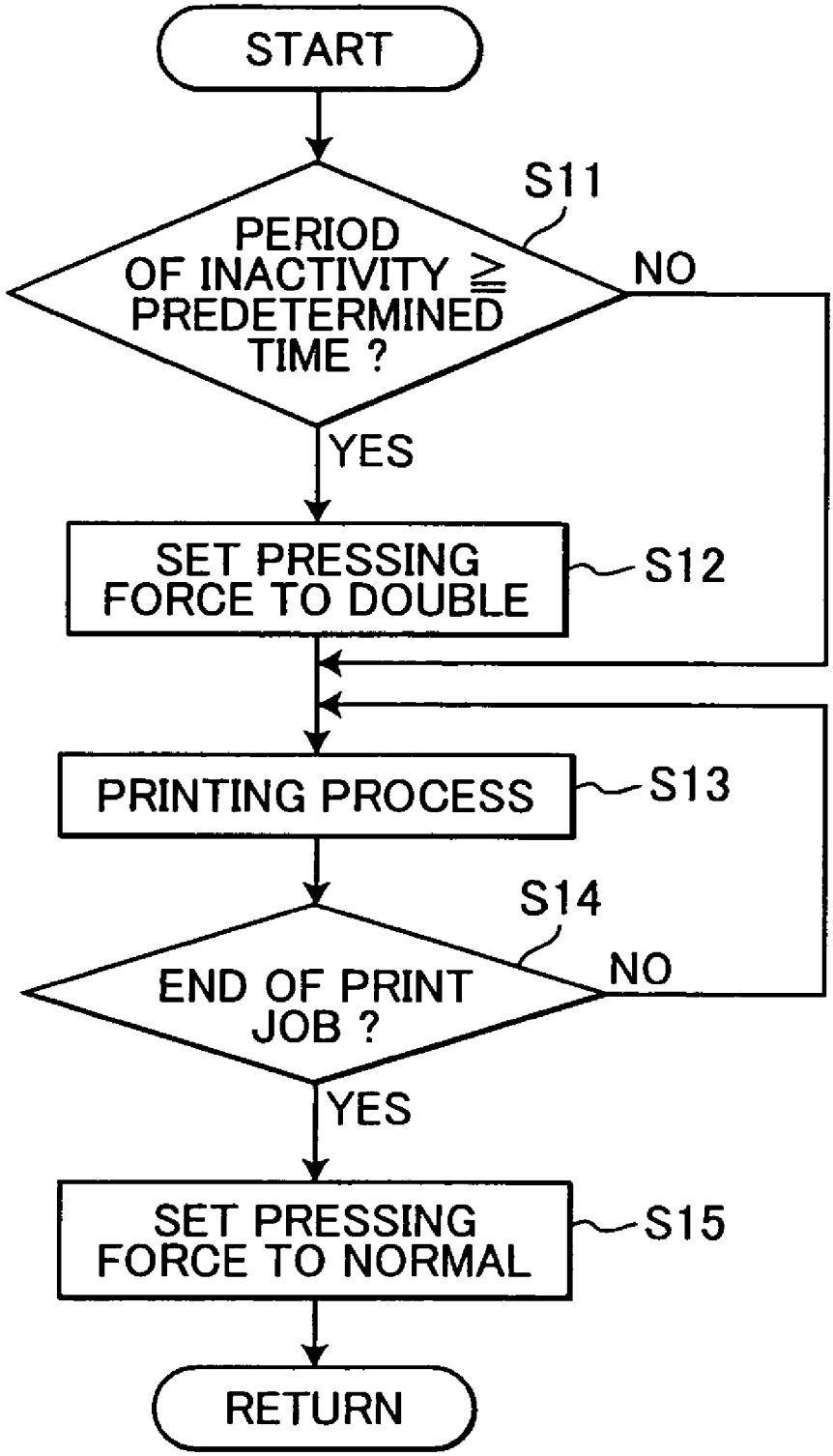
FIG. 10 is a flowchart showing an example of a first control mode in a short-term density adjusting program.

FIGS. 10 through 12 are flowcharts illustrating steps in a short-term density adjusting program. Next, the steps in the short-term density adjusting program will be described with reference to FIGS. 10 through 12.

The short-term density adjusting program includes three control modes a first control mode, second control mode, and third control mode. These control modes are selectively executed according to initial settings or input from the control panel 11.

FIG. 10 is a flowchart illustrating steps in the first control mode. The process in FIG. 10 is triggered by the reception of a print job.

At the beginning of the process in S11, the CPU 44 determines based on the timer 47 in the CPU 44 whether the time that has been measured since the previous printing operation, that is, the period of inactivity since the previous printing operation, is greater than or equal to a predetermined time. Specifically, the predetermined time is 5 hours in the present embodiment. If the measured time is less than the predetermined time (S11: NO), then a printing-process is begun in S13 without adjusting the pressing force. In S14 the CPU 44 determines whether the print job is completed. If the print job is not completed (S14: NO), then the printing process in S13 is continued until the print job is completed. When the print job is completed (S14: YES), the process ends and returns. In this case, because the pressing force is already set to normal, in S15 the normal pressing force is maintained.

However, if the CPU 44 determines in S11 that the measured time is greater than or equal to the predetermined time (S11: YES), then in S12 the CPU 44 controls the pressing-force adjusting unit 50 to set the pressing force to twice (double) the pressing force set at that time, and the printing process is begun in S13. For example, when the long-term density adjusting program is running in parallel to the short-term density adjusting program, and the accumulated number of printed sheets is greater than or equal to 2000, then the CPU 44 sets the pressing force to twice the pressing force of 700×9.8 mN at that time, i.e. 1400×9.8 mN. If the accumulated number of printed sheets is between 2001 and 4000, the CPU 44 sets the pressing force to twice the pressing force of 600×9.8 mN at that time, that is, 1200×9.8 mN. If the accumulated number of printed sheets is between 4001 and 6000, then the CPU 44 sets the pressing force to twice 500×9.8 mN, that is, 1000×9.8 mN.

Subsequently, by executing the first print job after a period of inactivity, the CPU 44 determines in S14 whether the number of sheets specified in the print job has been printed, that is, whether the initial print job is completed. If the print job is not completed (S14: NO), then the CPU 44 returns to the printing process in S13 and continues the process while maintaining the pressing force at twice the value. When the printing job is completed (S14: YES), then in S15 the CPU 44 controls the pressing-force adjusting unit 50 to reset the pressing force to the original (normal) value, ends the process, and returns.

Through the process of the first control mode described above, the CPU 44 controls the pressing-force adjusting unit 50 to temporarily maintain the pressing force at twice the value of the normal pressing force when a new printing operation is being performed a predetermined time (5 hours in the present embodiment) after the previous printing operation until the initial printing job is completed. For example, as shown in FIG. 13, the pressing force-is maintained at 1400×9.8 mN, twice the normal 700×9.8 mN during the first, fourth, eighth, and twelfth print jobs, which are the initial print jobs after a period of inactivity exceeding 5 hours. The example in FIG. 13 shows a case when the accumulated number of printed sheets is less than or equal to 2000.

Hence, the printer 1 of the present embodiment can easily and reliably adjust the density to compensate for a temporary drop in density after a long period of inactivity in order to print at an appropriate density on the paper 3 until the initial print job after the long period of inactivity is completed.

Since the drop in density after a long period of inactivity is temporary, it is sufficient to maintain the pressing force at twice its value until the initial printing job is completed, because the drop in density has the largest effect during the initial printing job. It is not necessary to increase the pressing force in subsequent printing jobs, as the effect of the drop in density is reduced. Accordingly, as in the example of FIG. 13, the pressing force is returned to the normal 700×9.8 mN in subsequent print jobs, that is, the second, fifths and ninth print jobs, following the corresponding initial print jobs following a period of inactivity that exceeds 5 hours, that is, the first, fourth, eight, and twelfth print jobs.

FIG. 11 is a flowchart illustrating the steps in the second control mode. The process in FIG. 11 is triggered by reception of a print job.

At the beginning of the process in S21, the CPU 44 determines whether a pressing force control flag is set to "1". The pressing force control flag is set in the RAM 46 for controlling the setting status of the pressing force. The control flag is set to "1" when the pressing force is set to twice the normal value and to "0" when the pressing force is set to its normal value.

If the pressing force control flag is not "1" (S21: No), indicating that the flag is set to "0" and that the setting status of the pressing force is the normal pressing force, then in S22 the CPU 44 determines according to the timer 47 whether the time that has elapsed since the previous printing operation, that is, the period of inactivity since the previous printing operation, has exceeded the predetermined time (5 hours in the present embodiment). If the measured time is less than the predetermined time (S22: NO), then in S23 the CPU 44 begins the printing process without adjusting the pressing force. In S24 the CPU 44 determines whether the print job is completed. If the print job is not completed (S24: NO), then the CPU 44 continues the printing process in S23 until the print job is completed. When the print job is completed (S24: YES), then the process ends and returns.

However, if the CPU 44 determines in S22 that the measured time is greater than or equal to the predetermined time (S22: YES), then in S25 the CPU 44 sets the pressing force control flag to "1". In S26 the CPU 44 controls the pressing-force adjusting unit 50 to set the pressing force to twice the value of the normal pressing force at that time. In S27 the CPU 44 begins counting the number of printed sheets following the period of inactivity. The number of printed sheets following a period of inactivity is stored as a count value in a predetermined area of the RAM 46.

On the other hand, if the pressing force control flag is "1" in S21 (S21: YES), indicating that the setting status of the pressing force is double the normal pressing force, then the CPU 44 jumps to S27 and begins counting the number of printed sheets following the period of inactivity.

Subsequently, in S28 one page of the printing process is executed, after which the CPU 44 determines in S29 whether the print job is completed. If the print job is not completed (S29: NO), then in S30 the CPU 44 determines whether the pressing force control flag is "1". If the pressing force control flag is "1" (S30; YES), indicating that the setting status of the pressing force is twice the normal pressing force, then in S31 the CPU 44 counts the number of printed pages since the period of inactivity. In S32 the CPU 44 determines whether the number of pages since the period of inactivity (the count value in RAM 46) exceeds a predetermined number of pages (20 pages in the present embodiment).

If the number of printed pages does not exceed the predetermined number of pages (S32: NO), then the CPU 44 returns to the printing process in S28 and performs the next page of the printing process while maintaining the pressing force at twice the value.

However, if the number of printed sheets exceeds the predetermined number of pages (S32: YES), then in S33 the CPU 44 clears the count value in the RAM 46, sets the pressing force control flag to "0", and controls the pressing-force adjusting unit 50 to reset the pressing force to the normal value. Subsequently, the CPU 44 returns to the printing process in S28 and prints the next page. Thereafter, while the print job has not completed (S29: NO), the pressing force control flag is "0". Therefore, the CPU 44 determines in S30 that the pressing force control flag is not "1" (S30: NO) and continues to perform the printing process in S28 until the print job is completed. When the print job is completed (S29: YES), then the process ends and returns.

In the process in the second control mode, if the count value stored in the RAM 46 (the number of printed pages after an inactive period) has not reached the predetermined number of pages at the time the first print job is completed, then the count value is maintained in the RAM 46.

In the process in the second control mode, after the predetermined number of sheets has been printed, the pressing force is immediately reset to the original pressing force. However, it is also possible to reset the pressing force to the original value after the print job, during which the predetermined number of pages is reached, has been completed. In other words, the CPU 44 does not reset the pressing force to the original value until the print job is completed.

Through the process of the second control mode described above, the CPU 44 controls the pressing-force adjusting unit 50 to temporarily maintain the pressing force at twice the value of the normal pressing force when a new printing operation is being performed a predetermined time (5 hours in the present embodiment) after the previous printing operation until the first predetermined number (20 in the present embodiment) of sheets of paper 3 after a period of inactivity has been printed. More specifically, the pressing force is maintained temporarily at twice the normal pressing force until the initial predetermined number of sheets has been printed after the period of inactivity.

In the example of FIG. 13, the pressing force is maintained at 1400×9.8 mN, twice the normal 700×9.8 mN during print jobs included in the first 20 pages following a period of inactivity that exceeds 5 hours, that is, the first print job, the fourth print job through part of the sixth print job (through the sixth page of the sixth print job), and the eight print job through part of the tenth print job (through the seventeenth page of the tenth print job).

Hence, the printer 1 of the present embodiment can easily and reliably adjust the density to compensate for a temporary drop in density after a long period of inactivity is in order to print at an appropriate density on the paper 3 until the initial predetermined number of sheets of paper 3 following a long period of inactivity have been printed.

Since the drop in density following a long period of inactivity is only temporary, it is not necessary to increase the pressing force during subsequent printing, as described above, since the effects of the drop in density decline. Accordingly, in the example of FIG. 13, the pressing force is returned to the normal 700×9.8 mN beginning from the second print job, the middle of the sixth print job (seventh page of the sixth print job), and the middle of the tenth print job (eighteenth page of the tenth print job).

FIG. 12 is a flowchart illustrating the steps in the third control mode. The process in FIG. 12 is triggered by reception of a print job.

At the beginning of the process in S41, the CPU 44 determines whether the specified number of sheets in the print job does not exceed a predetermined specified number of sheets (50 sheets in the present embodiment). If the specified number of sheets in the print job is greater than or equal to the predetermined specified number of sheets (S41: NO), then in S415 the CPU 44 sets the pressing force control flag to "0" if the pressing force control flag is "1", or maintains the pressing force control flag at "0" if the pressing force control flag is already "0". In S44 the paper supply unit 4 begins the printing process. In S45 the CPU 44 determines whether the print job is completed. If the print job is not completed (S45: NO), then the CPU 44 continues the printing process in S44 until the print job is completed. When the print job is completed (S45: YES), the process ends and returns.

However, if the specified number of sheets in the print job is less than the predetermined specified number of sheets (S41: YES), then in S42 the CPU 44 determines whether the pressing force control flag is "1". As described above, the pressing force control flag is set in the RAM 46 and functions to control the setting status of the pressing force. The control flag is set to "1" when setting the pressing force to double the normal value, and to "0" when setting the pressing force to the normal value.

If the pressing force control flag is not "1" (S42; NO), indicating that the control flag is set to "0" and that the setting status of the pressing force is the normal pressing force, then in S43 the CPU 44 determines based on the timer 47 whether the time that has elapsed since the previous printing operation, that is, the period of inactivity since the previous printing operation, has exceeded the predetermined time (5 hours in the present embodiment). If the measured time is less than the predetermined time (S43: NO), then in S44 the CPU 44 begins the printing process without adjusting the pressing force. In S45 the CPU 44 determines whether the print job is completed. If the print job is not completed (S45: NO), then the CPU 44 continues the printing process in S44 until the print job is completed. When the print job is completed (S45: YES), then the process ends and returns.

However, if the CPU 44 determines in S43 that the measured time is greater than or equal to the predetermined time (S43: YES), then in S46 the CPU 44 sets the pressing force control flag to "1". In S47 the CPU 44 controls the pressing-force adjusting unit 50 to set the pressing force to twice the value of the normal pressing force at that time. In S48 the CPU 44 begins counting the number of printed sheets following the period of inactivity. The number of printed sheets following a period of inactivity is stored as a count value in a predetermined area of the RAM 46.

Further, if the pressing force control flag is "1" in S42 (S42: YES), indicating that the setting status of the pressing force is double the normal pressing force, then the CPU 44 jumps to S48 and begins counting the number of printed sheets following the period of inactivity.

Subsequently, in S49 one page of the printing process is executed, after which the CPU 44 determines in S50 whether the print job is completed. If the print job is not completed (S50: NO), then in S51 the CPU 44 determines whether the pressing force control flag is "1" If the pressing force control flag is "1" (S51; YES), indicating that the setting status of the pressing force is twice the normal pressing force, then in S52 the CPU 44 counts the number of printed pages since the period of inactivity. In S53 the CPU 44 determines whether the number of pages since the period of inactivity (the count value in RAM 46) is greater than a predetermined number of pages (20 pages in the present embodiment).

If the number of printed pages is less than or equal to the predetermined number of pages (S53; NO), then the CPU 44 returns to the printing process in S49 and performs the next page of the printing process while maintaining the pressing force at twice the normal pressing force.

However, if the number of printed sheets is greater than the predetermined number of pages (S53: YES), then in S54 the CPU 44 clears the count value in the RAM 46, sets the pressing force control flag to "0", and controls the pressing-force adjusting unit 50 to reset the pressing force to the normal value. Subsequently, the CPU 44 returns to the printing process in S49 and prints the next page. Here, the pressing force control flag is "0". Therefore, while the print job has not completed (S50: NO), the CPU 44 determines in S51 that the pressing force control flag is not "1" (S51: NO) and continues to perform the printing process in S49 until the print job is completed. When the print job is completed (S50: YES), then the process ends and returns.

In this process, if the count value stored in the RAM 46 (the number of printed pages after an inactive period) has not reached the predetermined number of pages when the first print job is completed, then the count value is maintained in the RAM 46.

When the predetermined number of sheets has been printed in the process of the third control mode, the pressing force is immediately reset to the original pressing force. However, it is also possible to reset the pressing force to the original value after the print job, during which the predetermined number of pages is reached, is completed.

Through the process of the third control mode described above, the CPU 44 controls the pressing-force adjusting unit 50 to temporarily adjust the pressing force at twice the value of the normal pressing force when a new printing operation is being performed a predetermined time (5 hours in the present embodiment) after the previous printing operation until the predetermined number (20 in the present embodiment) of sheets of paper 3 after the period of inactivity has been printed, provided that the specified number of sheets in print jobs being executed during this time does not exceed the predetermined specified number of sheets (50 sheets in the present embodiment). More specifically, the pressing force is maintained temporarily at twice the normal pressing force while the predetermined number of sheets after the period of inactivity is printed, provided that the specified number of sheets in print jobs being executed during this time does not exceed the predetermined specified number of sheets (50 sheets in the present embodiment). In other words, the pressing force is adjusted in an increased state during developing of a predetermined number N of sheets from the first sheet after the inactivity time until the Nth sheet, if a specified number of sheets for print jobs being executed during the developing is smaller than the predetermined specified number of sheets (50 sheets in the present embodiment).

In the example of FIG. 13, the pressing force is maintained at 1400×9.8 mN, twice the normal 700×9.8 mN during print jobs included in the first 20 pages following a period of inactivity that exceeds 5 hours, that is, the first print job, and the fourth print job through part of the sixth print job (through the sixth page of the sixth print job).

Hence, the printer 1 of the present embodiment can easily and reliably adjust the density to compensate for a temporary drop in density after a long period of inactivity in order to print at an appropriate density on the paper 3 until the initial predetermined number of sheets of paper 3 following a long period of inactivity have been printed, provided that the specified number of sheets in print jobs being executed at this time does not exceed the predetermined specified number of sheets (50 sheets in the present embodiment).

Since the drop in density following a long period of inactivity is only temporary, it is not necessary to increase the pressing force during subsequent printing, as described above, since the effects of the drop in density decline. Accordingly, in the example of FIG. 13, the pressing force is returned to the normal 700×9.8 mN beginning from the second print job, and the middle of the sixth print job (seventh page of the sixth print job).

If the print job has a large specified number of sheets, there is a danger that switching the pressing force during the print job will take considerable time and may result in a change in density during the same print job. However, with the process of the third control mode, the print job is printed at the normal pressing force from the beginning of the job when the specified number of sheets in the print job exceeds a predetermined number of sheets (50 sheets in the present embodiment). Accordingly, images can be formed at an appropriate density on sheets of the paper 3 which are affected by the drop in density.

In the example of FIG. 13, the tenth print job is included in the first 20 pages following a period of inactivity that exceeds 5 hours, but has 200 specified number of sheets. Since the specified number of sheets exceeds the predetermined specified number of sheets of 50, the pressing force is returned to the normal 700×9.8 mN.

Hence, in the printer 1 having the above-described construction, the CPU 44 controls the developing bias applying device 43 and the pressing-force adjusting unit 50 to adjust the density of a toner image through the combination of developing bias and pressing force. Accordingly, control of the developing bias can be simplified more than when adjusting density of the toner image using only the developing bias. As a result, the printer 1 can achieve reliable density adjustment through a simple construction and a simple control that compensates for temporary drops in density following long periods of inactivity and density increasing over time as toner is consumed, while reducing memory consumption required for the control.

In other words, with the printer 1 having the above-described construction, the CPU 44 controls adjustment of the toner image density through a combination of electrical density adjustment with the developing bias applying device 43 and mechanical density adjustment with the pressing-force adjusting unit 50. Accordingly, it is possible to achieve a more simple control with the developing bias applying device 43 than when the toner image density is adjusted only by the developing bias applying device 43, enabling reliable density adjustment through a simple construction and control.

With the density adjusting program stored in the ROM 45, the CPU 44 controls the developing bias applying device 43 and pressing-force adjusting unit 50 according to the long-term density adjusting program to compensate for long-term changes in density and controls the pressing-force adjusting unit 50 according to the short-term density adjusting program to compensate for short-term changes in density. As a result, the image forming device can achieve suitable density adjustment for temporary drops in density after long periods of inactivity and density increases over time accompanying toner consumption.

Hence, the printer 1 can form toner images in each color at a stable density, thereby achieving stable color image formation.

While the invention has been described in detail with reference to the specific embodiment thereof, it would be apparent to those skilled in the art that various changes and modifications may be made therein without departing from the spirit of the invention.

For example, in the above-described embodiment, the cam 53 of the pressing-force adjusting unit 50 is formed in an elliptical shape, integrally provided with the long radius portion 56 and the short radius portion 57. However, the cam 53 is not limited to this shape.

Figure 14A:
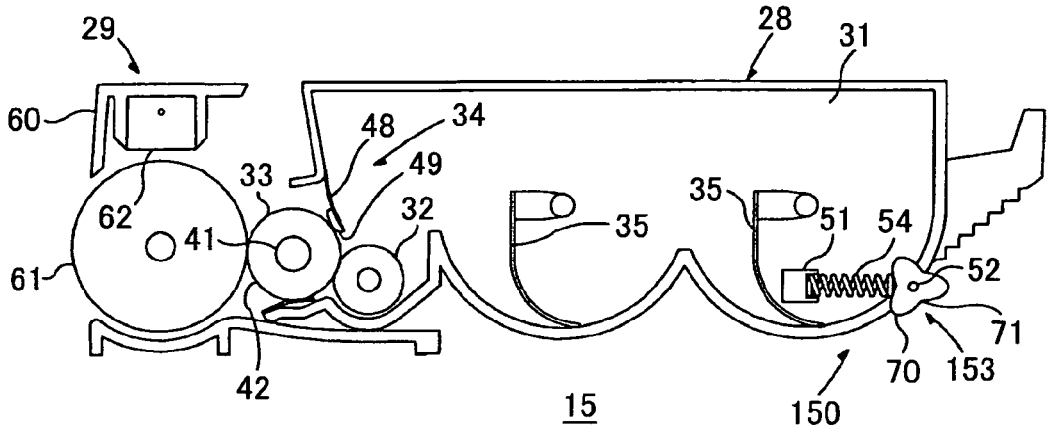
FIG. 14(*a*) is a vertical cross-sectional view showing a process cartridge according to a first modification with a cam having a substantially triangular shape.
Figure 14B:
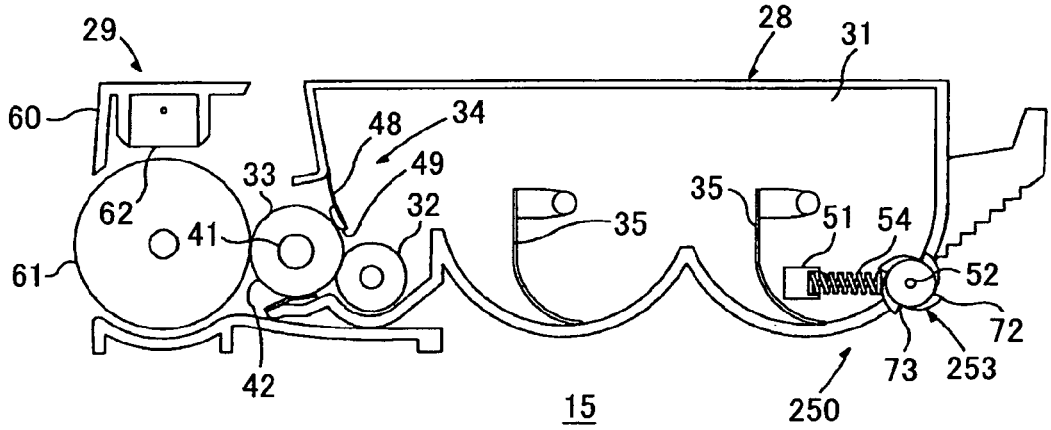

As shown in FIG. 14(*a*), a pressing-force adjusting unit 150 according to a first modification includes a cam 153 having a substantially triangular shape integrally provided with three protruding portions 70 extending outward in the radial direction and recess portions 71 formed between neighboring protruding portions 70. With the cam 153, the spring 54 is in a strong pressure state when the protruding portions 70 contact the spring 54 and in a weak pressure state when the recess portions 71 contact the spring 54.

As shown in FIG. 14(*b*), a pressing-force adjusting unit 250 according to a second modification includes a cam 253 that is formed substantially in a windmill shape integrally provided with a plurality of blade portions 72 that can rotate unidirectionally and step portions 73 formed between neighboring blade portions 72. With the cam 253, the spring 54 is in a strong pressure state when the blade portions 72 contact the spring 54 and in a weak pressure state when the step portions 73 contact the spring 54.

Figure 15:
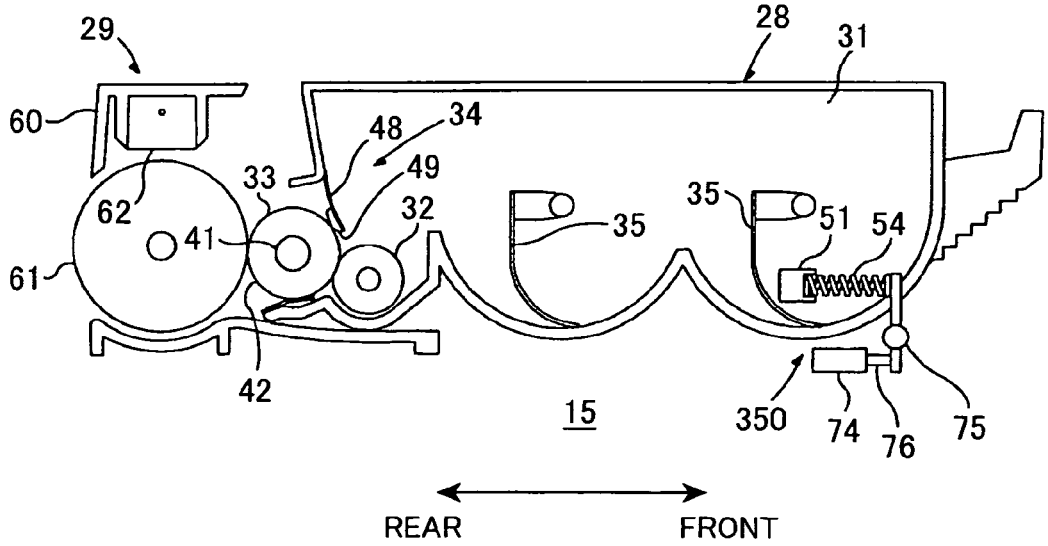
FIG. 15 is a vertical cross-sectional view showing a process cartridge according to a third modification in which a pressing-force adjusting unit employs a solenoid and a pivoting lever.

As shown in FIG. 15, a pressing-force adjusting unit 350 according to a third modification includes a solenoid 74 and a pivoting lever 75 instead of the cam shaft 52 and the cam 53.

More specifically, in the pressing-force adjusting unit 350, the pivoting lever 75 is rotatably supported on the main casing 2 in the middle of the length thereof, and the top portion of the pivoting lever 75 is coupled with the front end of the spring 54 (the end opposite to the spring receiving portion 51). Further, the solenoid 74 is provided with a plunger 76 that extends and retracts in the front-to-rear direction. The end part of the plunger 76 is coupled with the bottom part of the pivoting lever 75.

With the pressing-force adjusting unit 350, the plunger 76 is extended and retracted in the front-to-rear direction by exciting or not exciting the solenoid 74. When the plunger 76 is extended toward the front, the plunger 76 presses the bottom part of the pivoting lever 75 forward, causing the pivoting lever 75 to rotate and the top part of the pivoting lever 75 to press rearward. Accordingly, the spring 54 is compressed into the strong pressure state. On the other hand, when the plunger 76 is retracted rearward, the urging force of the spring 54 presses the top part of the pivoting lever 75 forward, allowing the spring 54 to uncompress into the weak pressure state.

By employing the solenoid 74 and the pivoting lever 75 in the pressing-force adjusting unit 350 described above, the pressing-force adjusting unit 350 can be constructed with simple components at a low cost.

Figure 16A:
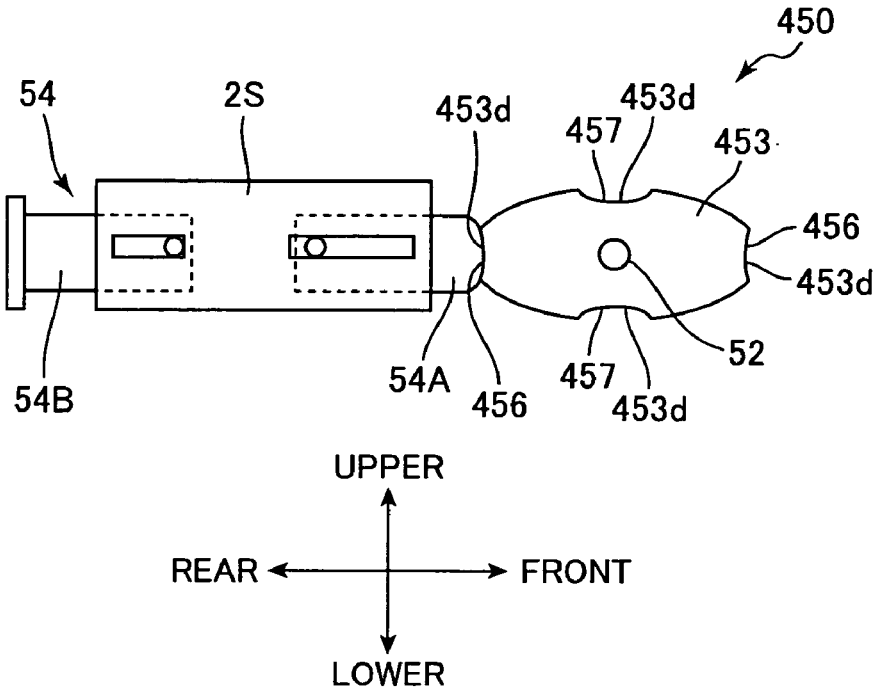
FIG. 16(*a*) is a side view showing a cam and a spring of a pressing-force adjusting unit according to a fourth modification in a strong pressure state.
Figure 16B:
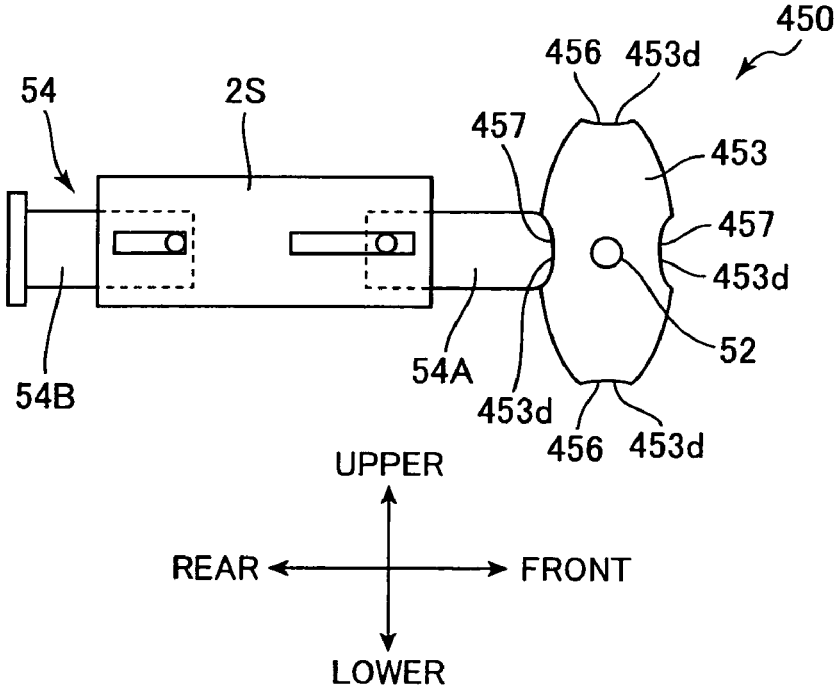

As shown in FIGS. 16(*a*) and 16(*b*), a pressing-force adjusting unit 450 according to a fourth modification includes a cam 453 having depressed portions 453*d*. FIG. 16(*a*) shows the cam 453 and the spring 54 in a strong pressure state described above, and FIG. 16(*b*) shows a weak pressure state. Like the cam 53 in the above-described embodiment, the cam 453 is formed in a substantially elliptical shape including a long radius portion 456 that is long in the latitudinal direction and a short radius portion 457 that is shorter than the long radius portion 456. The depressed portions 453*d* are formed in the peripheral surface of the cam 453 for receiving the front sliding member 54A of the spring 54. With the cam 453 according to the fourth modification, the cam 453 can receive and press the front sliding member 54A in a stable manner. Obviously, a larger number of depressed portions 453*d* may be formed.

The shapes of cams are not limited to the cams 53, 153, 253, and 453 in the above-described embodiment and modifications. The cams can be designed in various shapes according to required pressing force between the developing roller 33 and photosensitive drum 61. Further, the spring member 54S can also be selected from various specifications according to required pressing force between the developing roller 33 and photosensitive drum 61. That is, the pressing force can be set to required values by modifying the cams and springs.

What is claimed is:

1. An image forming device comprising:

a developer bearing member bearing developer;

a photosensitive member disposed in contact with the developer bearing member, an electrostatic latent image being formed on the photosensitive member and developed by the developer supplied from the developer bearing member for forming a developer image, a pressing force being exerted between the developer bearing member and the photosensitive member;

a developing-bias applying portion applying a developing bias to the developer bearing member;

a pressing-force adjusting portion adjusting the pressing force between the developer bearing member and the photosensitive member; and a density adjusting portion controlling both the developing-bias applying portion and the pressing-force adjusting portion to adjust, based on adjustment of both the developing bias and the pressing force, an amount of developer in the developer image developed on the photosensitive member, thereby adjusting density of a developer image on a recording medium.

2. The image forming device as claimed in claim 1, further comprising a time measuring portion measuring an amount of inactivity time that has elapsed since a previous developing operation, wherein the density adjusting portion controls the pressing-force adjusting portion to change the pressing force in a new developing operation when the elapsed time measured by the time measuring portion is greater than or equal to a predetermined time.

3. The image forming device as claimed in claim 2, wherein the density adjusting portion controls the pressing-force adjusting portion to increase the pressing force temporarily from the pressing force prior to the change.

4. The image forming device as claimed in claim 3, wherein the density adjusting portion controls the pressing-force adjusting portion to adjust the pressing force in an increased state until a first print job is completed at developing after the inactivity time.

5. The image forming device as claimed in claim 3, wherein the density adjusting portion controls the pressing-force adjusting portion to adjust the pressing force in an increased state until a predetermined number of sheets of the recording medium has been printed at developing after the inactivity time.

6. The image forming device as claimed in claim 3, wherein the density adjusting portion controls the pressing-force adjusting portion to adjust the pressing force in an increased state during developing of a predetermined number N of sheets from a first sheet after the inactivity time until an Nth sheet, if a specified number of sheets for a print job that is executed during the developing is smaller than a predetermined specified number of sheets.

7. The image forming device as claimed in claim 1, further comprising a developing-amount measuring portion measuring an accumulated amount of developer consumed for developing developer images, wherein the density adjusting portion controls the developing-bias applying portion to change the developing bias based on the accumulated amount of developer measured by the developing-amount measuring portion.

8. The image forming device as claimed in claim 7, wherein the developing-amount measuring portion includes a recording-medium-number detecting portion detecting an accumulated number of printed sheets of the recording medium.

9. The image forming device as claimed in claim 7, wherein the developing-amount measuring portion includes a developer-amount detecting portion detecting an amount of consumed developer.

10. The image forming device as claimed in claim 7, wherein the developing-amount measuring portion includes a rotation detecting portion detecting a number of rotations of the developer bearing member.

11. The image forming device as claimed in claim 7, wherein the density adjusting portion controls the developing-bias applying portion to reduce the developing bias as the accumulated amount of developer increases.

12. The image forming device as claimed in claim 7, wherein the density adjusting portion controls, according to the accumulated amount of developer, the pressing-force adjusting portion to change the pressing force.

13. The image forming device as claimed in claim 12, wherein the density adjusting portion controls the pressing-force adjusting portion to reduce the pressing force as the accumulated amount of developer increases.

14. The image forming device as claimed in claim 1, wherein the pressing-force adjusting portion adjusts the pressing force within a range greater than a lower limit and smaller than an upper limit, the lower limit being set to a force greater than a pressing force at which the developer bearing member fails to contact the photosensitive member with uniform pressure along its longitudinal direction, the upper limit being set to a force smaller than a pressing force at which fogging is produced on the recording medium.

15. The image forming device as claimed in claim 14, wherein the pressing force of the lower limit is 400×9.8 mN; and wherein the fogging is determined to be generated on the recording medium when a $\Delta Y$ value of the recording medium measured by a reflection densitometer is greater than or equal to 5.

16. The image forming device as claimed in claim 1, wherein the pressing-force adjusting portion includes:

an urging member urging the developer bearing member toward the photosensitive member; and an urging-force changing member changing the urging force of the urging member.

17. The image forming device as claimed in claim 16, wherein the urging member is a spring, and wherein the urging-force changing member is one of a cam and a solenoid.

18. The image forming device as claimed in claim 17, further comprising:

a main casing;

a developing cartridge in which the developer bearing member is disposed; and a photosensitive-member cartridge in which the photosensitive member is disposed, the developing cartridge being detachably mounted on the photosensitive-member cartridge, wherein the urging member urges the developing cartridge toward the photosensitive-member cartridge.

19. The image forming device as claimed in claim 18, wherein the urging-force changing member is a cam having at least a first radius portion and a second radius portion, the first radius portion having a longer radius than the second radius portion;

wherein the spring has one end and another end opposite to the one end;

wherein the pressing-force adjusting portion further includes:

a cam shaft extending along its central axis and fixed to the cam, the cam shaft being rotatably disposed at the main casing, allowing the cam shaft and the cam to be rotatable about the central axis of the cam shaft: and a spring receiving portion disposed at the developing cartridge for receiving the one end of the spring, the spring being disposed between the spring receiving portion and the cam;

wherein, when the cam is in a rotational position at which the first radius portion contacts the another end of the spring, the spring urges the spring receiving portion with a first urging force, allowing the developer bearing member and the photosensitive member to be in a first pressure state; and wherein, when the cam is in another rotational position at which the second radius portion contacts the another end of the spring, the spring urges the spring receiving portion with a second urging force smaller than the first urging force, allowing the developer bearing member and the photosensitive member to be in a second pressure state in which the pressing force is smaller than in the first pressure state.

20. The image forming device as claimed in claim 1, comprising a plurality of the developer bearing members each provided for each of a plurality of colors in order to form color images on the recording medium.

21. A process cartridge comprising:

a developer bearing member bearing developer; and a photosensitive member disposed in contact with the developer bearing member, an electrostatic latent image being formed on the photosensitive member and developed by the developer supplied from the developer bearing member for forming a developer image, a pressing force being exerted between the developer bearing member and the photosensitive member, the developer bearing member being disposed to press the photosensitive member by the pressing force adjusted by a pressing-force adjusting portion, the developer bearing member being applied with a developing bias by a developing-bias applying portion in order to adjust, in combination with the pressing force adjusted by the pressing-force adjusting portion, an amount of developer in the developer image developed on the photosensitive member, thereby adjusting density of a developer image on a recording medium.

22. The process cartridge as claimed in claim 21, further comprising:

a developing cartridge in which the developer bearing member is disposed; and a photosensitive-member cartridge in which the photosensitive member is disposed, the developing cartridge being detachably mounted on the photosensitive-member cartridge, wherein the pressing-force adjusting portion urges the developing cartridge toward the photosensitive-member cartridge.

23. The process cartridge as claimed in claim 22, wherein the developing cartridge is fixedly provided with an urging-member receiving portion that receives an urging member of the pressing-force adjusting portion.

24. An image forming device comprising:

a developer bearing member bearing developer;

a photosensitive member disposed in contact with the developer bearing member, an electrostatic latent image being formed on the photosensitive member and developed by the developer supplied from the developer bearing member for forming a developer image;

an electrical density adjusting portion electrically adjusting an amount of developer in the developer image developed on the photosensitive member;

a mechanical density adjusting portion mechanically adjusting the amount of developer in the developer image developed on the photosensitive member; and a density adjusting portion controlling both the electrical density adjusting portion and the mechanical density adjusting portion to adjust the amount of developer in the developer image developed on the photosensitive member, thereby adjusting density of a developer image on a recording, medium.

25. The image forming device as claimed in claim 24, wherein the density adjusting portion controls both the electrical density adjusting portion and the mechanical density adjusting portion in combination to adjust the amount of developer, thereby responding to long-term changes in the density and to short-term changes in the density on a recording medium.

26. The image forming device as claimed in claim 25, wherein the electrical density adjusting portion adjusts the amount of developer to respond to the long-term changes in the density; and wherein the mechanical density adjusting portion adjusts the amount of developer to respond to the short-term changes in the density.

* * * * *